US009776431B2

(12) United States Patent
Uemura

(10) Patent No.: US 9,776,431 B2
(45) Date of Patent: Oct. 3, 2017

(54) MEDIUM CONVEYING DEVICE AND IMAGE RECORDING APPARATUS

(71) Applicant: FUJIFILM Corporation, Tokyo (JP)

(72) Inventor: Hiroshi Uemura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/429,905

(22) Filed: Feb. 10, 2017

(65) Prior Publication Data

US 2017/0151811 A1 Jun. 1, 2017

Related U.S. Application Data

(63) Continuation of application No. PCT/JP2015/060537, filed on Apr. 3, 2015.

(30) Foreign Application Priority Data

Sep. 5, 2014 (JP) ..... 2014-180918

(51) Int. Cl.
*B41J 11/00* (2006.01)
*B41J 13/22* (2006.01)
(Continued)

(52) U.S. Cl.
CPC ..... *B41J 11/0045* (2013.01); *B41J 11/007* (2013.01); *B41J 11/0085* (2013.01);
(Continued)

(58) Field of Classification Search
CPC ..... B41J 11/007; B41J 11/0085; B41J 11/04; B41J 11/057; B41J 11/06; B41J 13/22; B41J 13/223; B41J 13/226
See application file for complete search history.

(56) References Cited

U.S. PATENT DOCUMENTS 6,786,590 B2 * 9/2004 Maki ..... B41J 11/007 271/193
7,137,750 B2 * 11/2006 Fujioka ..... B41J 3/46 347/104
(Continued)

FOREIGN PATENT DOCUMENTS

JP 2000-191175 A 7/2000
JP 2000-229747 A 8/2000
(Continued)

OTHER PUBLICATIONS

International Search Report issued in PCT/JP2015/060537; dated Jun. 23, 2015.
(Continued)

*Primary Examiner* — Anh T. N. Vo
(74) *Attorney, Agent, or Firm* — Studebaker & Brackett PC

(57) ABSTRACT

There are provided a medium conveying device and an image recording apparatus that can convey a medium without the generation of wrinkles and floating. Projections having the same size are regularly disposed on the peripheral surface of an image recording drum to form recessed portions and protruding portions on the peripheral surface of the image recording drum. An interval between the projections disposed in a middle region is set to be smaller than an interval between the projections disposed in both end regions. Accordingly, when a sheet is pressed against the peripheral surface of the image recording drum by a pressing roller, forces for pulling the sheet to the outside from the middle in a width direction can be generated. As a result, the sheet can be made to come into close contact with the peripheral surface of the image recording drum without the generation of wrinkles and floating.

20 Claims, 30 Drawing Sheets

(51) Int. Cl.

| | |
|---|---|
| ***B41J 11/057*** | (2006.01) |
| ***B41J 11/04*** | (2006.01) |
| ***B41J 11/06*** | (2006.01) |

(52) U.S. Cl.

CPC ..... *B41J 11/04* (2013.01); *B41J 11/057* (2013.01); *B41J 11/06* (2013.01); *B41J 13/22* (2013.01); *B41J 13/223* (2013.01); *B41J 13/226* (2013.01)

(56) References Cited

U.S. PATENT DOCUMENTS

| | | | |
|---|---|---|---|
| 7,530,687 | B2 | 5/2009 | Ishii et al. |
| 9,211,732 | B2 * | 12/2015 | Ishikawa ..... B41J 11/0085 |
| 2012/0019606 | A1 | 1/2012 | Fukui |
| 2013/0162742 | A1 | 6/2013 | Inoue et al. |

FOREIGN PATENT DOCUMENTS

| | | | |
|---|---|---|---|
| JP | 2004-268416 | A | 9/2004 |
| JP | 2012-024990 | A | 2/2012 |
| JP | 2013-151149 | A | 8/2013 |

OTHER PUBLICATIONS

International Preliminary Report on Patentability issued in PCT/JP2015/060537; dated Dec. 22, 2015.

* cited by examiner

MEDIUM CONVEYING DEVICE AND IMAGE RECORDING APPARATUS

CROSS-REFERENCE TO RELATED APPLICATIONS

This application is a Continuation of PCT International Application No. PCT/JP2015/060537 filed on Apr. 3, 2015, which claims priority under 35 U.S.C §119(a) to Japanese Patent Application No. 2014-180918 filed on Sep. 5, 2014. Each of the above application(s) is hereby expressly incorporated by reference, in its entirety, into the present application.

BACKGROUND OF THE INVENTION

1. Field of the Invention

The present invention relates to a medium conveying device that conveys a sheet-like medium, and an image recording apparatus using the medium conveying device.

2. Description of the Related Art

When a sheet used for printing is in a high-humidity environment, the sheet includes moisture and is deformed. Further, since a portion, to which ink has been applied, of a sheet having been subjected to printing is lengthened, the sheet having been subjected to printing is also deformed. This deformation of the sheet is referred to as curl or cockle.

When the deformed sheet is conveyed by a drum or a belt and is subjected to printing by an ink jet method, a slow distance (the flight distance of an ink droplet) is changed. For this reason, there is a problem that the quality of an image to be printed may deteriorate. Further, there is also a problem that the sheet may come into contact with a print head and may cause a trouble.

In order to solve these problems, in the related art, a sheet conveyed by a drum or a belt has been made to be even by a roller so that the deformation of the sheet is removed.

However, the amount of deformation of the sheet is not constant and a variation is usually present at each position in one sheet. When the sheet having a variation in the amount of deformation is made to be even uniformly by a roller, there is no position to which a large amount of original deformation of the sheet escapes. For this reason, finally, there is a problem that wrinkles and floating may be generated.

For example, in the case of a sheet which a high-density image is recorded at both end portions thereof in a width direction, the deformation of both the end portions of the sheet is greater than that of the middle portion of the sheet. Accordingly, when the sheet is made to be even uniformly by a roller, there is no position to which deformation generated at both the end portions escapes. For this reason, since deformation is concentrated on the middle portion of the sheet, there is a problem that wrinkles and floating may be generated at the middle portion.

In order to solve this problem, JP2012-24990A discloses a technique for suppressing the generation of wrinkles and floating by forming stepped portions, which further protrude than a middle portion, at both end portions of a drum in a width direction.

Further, JP2013-151149A and JP2000-191175A disclose techniques for absorbing the deformation of a sheet by recessed portions to suppress the generation of wrinkles and floating by forming recessed portions and protruding portions on the peripheral surface, which is a sheet holding surface, of a drum or a belt.

SUMMARY OF THE INVENTION

However, since a method of JP2012-24990A has a limit on the amount of deformation of a sheet that can be absorbed, there is a drawback that the method cannot cope with a sheet of which the amount of deformation is large. That is, it is necessary to increase the sizes of the stepped portions to increase capacity for absorbing the deformation of a sheet by the method of JP2012-24990A. However, there is a drawback that a mark may be formed on a sheet at boundary portions of the stepped portions when the sizes of stepped portions are increased. Further, there is also a drawback that the unevenness of an image may occur at the boundary portions.

Since the deformation of a sheet is averagely absorbed by the entire sheet holding surface in methods of JP2013-151149A and JP2000-191175A, there is an advantage that a difference in height formed by the recessed portions and the protruding portions can be reduced in comparison with the method of JP2012-24990A.

However, since there is a limit on the amount of deformation of a sheet that can be absorbed by each of the recessed portions, there is a drawback that wrinkles and floating may be generated since all the deformation of a sheet cannot be absorbed in the case of a sheet that is significantly and locally deformed.

The invention has been made in consideration of the above-mentioned circumstances, and an object of the invention is to provide a medium conveying device and an image recording apparatus that can convey a medium without the generation of wrinkles and floating.

Means for achieving the above-mentioned object is as follows.

(1) A medium conveying device comprising: a conveying unit for conveying a sheet-like medium while making the sheet-like medium come into close contact with a moving medium holding surface; and a pressing unit for making the medium come into close contact with the medium holding surface by pressing the medium against the medium holding surface. The medium holding surface includes recessed portions and protruding portions, and the recessed portions and the protruding portions have a shape in which the volume of recessed portions per unit area of the medium holding surface at both end portions in a width direction that is a direction orthogonal to a conveying direction of the medium is larger than the volume of the recessed portions per unit area of the medium holding surface at a middle portion in the width direction.

According to this aspect, the medium holding surface, which holds a medium, includes recessed portions and protruding portions. The recessed portions and the protruding portions have a shape in which the volume of recessed portions per unit area of the medium holding surface at both end portions in a width direction that is a direction orthogonal to a conveying direction of the medium is larger than the volume of the recessed portions per unit area of the medium holding surface at a middle portion in the width direction. Since the medium holding surface includes the recessed portions and the protruding portions, the deformation of the medium can be absorbed by the recessed portions. Further, since the volume of the recessed portions per unit area at the middle portion is made to be different from that at both the end portions, capacity for absorbing deformation at the middle portion can be made to be different from that at both the end portions. That is, capacity for absorbing deformation is set to be larger at both the end portions. Accordingly, when the medium is pressed by the pressing unit, forces for pulling the medium toward both end portions from the middle in the width direction can be generated. As a result, the generation of wrinkles and floating can be effectively suppressed.

(2) The medium conveying device according to (1), in which the recessed portions and the protruding portions have a shape in which the volume of the recessed portions per unit area of the medium holding surface in a region, which has a predetermined width, of both the end portions in the width direction is larger than the volume of the recessed portions per unit area of the medium holding surface at the middle portion in the width direction.

According to this aspect, the recessed portions and the protruding portions are formed so that the volume of the recessed portions per unit area of the medium holding surface in a region, which has a predetermined width, of both the end portions in the width direction is larger than the volume of the recessed portions per unit area of the medium holding surface at the middle portion.

(3) The medium conveying device according to (1), in which the recessed portions and the protruding portions have a shape in which the volume of the recessed portions per unit area of the medium holding surface is gradually increased toward both ends from a middle in the width direction.

According to this aspect, the recessed portions and the protruding portions are formed so that the volume of the recessed portions per unit area of the medium holding surface is gradually increased toward both the ends from the middle in the width direction.

(4) The medium conveying device according to (1), in which the recessed portions and the protruding portions have a shape in which the volume of the recessed portions per unit area of the medium holding surface is increased in stages toward both ends from a middle in the width direction.

According to this aspect, the recessed portions and the protruding portions are formed so that the volume of the recessed portions per unit area of the medium holding surface is increased in stages toward both the ends from the middle in the width direction.

(5) The medium conveying device according to any one of (1) to (4), in which protruding portions having the same size are regularly disposed on the medium holding surface, so that the recessed portions and the protruding portions are formed on the medium holding surface, and the recessed portions and the protruding portions are formed in a shape in which an interval between adjacent protruding portions disposed at the middle portion in the width direction is different from an interval between adjacent protruding portions disposed at both the end portions in the width direction, so that the volume of the recessed portions per unit area of the medium holding surface at both the end portions in the width direction is larger than the volume of the recessed portions per unit area of the medium holding surface at the middle portion in the width direction.

According to this aspect, protruding portions having the same size are regularly disposed on the medium holding surface, so that the recessed portions and the protruding portions are formed on the medium holding surface. Further, the volume of the recessed portions per unit area of the medium holding surface in the width direction is changed by a change in the interval between the protruding portions. That is, the recessed portions and the protruding portions are formed in a shape in which an interval between the protruding portions disposed at both the end portions in the width direction is set to be wider than an interval between the protruding portions disposed at the middle portion in the width direction, so that the volume of the recessed portions per unit area of the medium holding surface at both the end portions in the width direction is larger than the volume of the recessed portions per unit area of the medium holding surface at the middle portion in the width direction.

(6) The medium conveying device according to any one of (1) to (4), in which protruding portions are regularly disposed on the medium holding surface at regular intervals, so that the recessed portions and the protruding portions are formed on the medium holding surface, and the recessed portions and the protruding portions are formed in a shape in which the area of the surface, which comes into contact with the medium, of each of the protruding portions disposed at the middle portion in the width direction is different from the area of the surface, which comes into contact with the medium, of each of the protruding portions disposed at both the end portions in the width direction, so that the volume of the recessed portions per unit area of the medium holding surface at both the end portions in the width direction is larger than the volume of the recessed portions per unit area of the medium holding surface at the middle portion in the width direction.

According to this aspect, the protruding portions are regularly disposed on the medium holding surface at regular intervals, so that the recessed portions and the protruding portions are formed on the medium holding surface. Further, the volume of the recessed portions per unit area of the medium holding surface in the width direction is changed by a change in the area of the surface, which comes into contact with the medium, of each of the protruding portions. For example, when the protruding portion has a columnar shape, the recessed portions and the protruding portions are formed in a shape in which the diameter of each of the protruding portions disposed at both the end portions in the width direction is smaller than the diameter of each of the protruding portions disposed at the middle portion in the width direction, so that the volume of the recessed portions per unit area of the medium holding surface at both the end portions in the width direction is larger than the volume of the recessed portions per unit area of the medium holding surface at the middle portion in the width direction.

(7) The medium conveying device according to any one of (1) to (4), in which protruding portions are regularly disposed on the medium holding surface at regular intervals, so that the recessed portions and the protruding portions are formed on the medium holding surface, and the recessed portions and the protruding portions are formed in a shape in which the height of each of the protruding portions disposed at the middle portion in the width direction is different from the height of each of the protruding portions disposed at both the end portions in the width direction, so that the volume of the recessed portions per unit area of the medium holding surface at both the end portions in the width direction is larger than the volume of the recessed portions per unit area of the medium holding surface at the middle portion in the width direction.

According to this aspect, the protruding portions are regularly disposed on the medium holding surface at regular intervals, so that the recessed portions and the protruding portions are formed on the medium holding surface. Further, the volume of the recessed portions per unit area of the medium holding surface in the width direction is changed by a change in the height of each of the protruding portions. That is, the recessed portions and the protruding portions are formed in a shape in which the height of each of the protruding portions disposed at both the end portions in the width direction is larger than the height of each of the protruding portions disposed at the middle portion in the width direction, so that the volume of the recessed portions disposed at both the end portions in the width direction is larger than the volume of the recessed portions disposed at the middle portion in the width direction.

(8) The medium conveying device according to any one of (1) to (4), in which protruding portions are regularly disposed on the medium holding surface, so that the recessed portions and the protruding portions are formed on the medium holding surface, and the recessed portions and the protruding portions are formed in a shape in which at least one of the interval between adjacent protruding portions disposed at the middle portion in the width direction, the area of the surface, which comes into contact with the medium, of each of the protruding portions disposed at the middle portion in the width direction, or the height of each of the protruding portions disposed at the middle portion in the width direction is different from the interval between adjacent protruding portions disposed at both the end portions in the width direction, the area of the surface, which comes into contact with the medium, of each of the protruding portions disposed at both the end portions in the width direction, or the height of each of the protruding portions disposed at both the end portions in the width direction, respectively, so that the volume of the recessed portions per unit area of the medium holding surface at both the end portions in the width direction is larger than the volume of the recessed portions per unit area of the medium holding surface at the middle portion in the width direction.

According to this aspect, the protruding portions are regularly disposed on the medium holding surface, so that the recessed portions and the protruding portions are formed on the medium holding surface. Further, the volume of the recessed portions per unit area of the medium holding surface in the width direction is changed by a change in at least one of the interval between the protruding portions, the area of the surface, which comes into contact with the medium, of each of the protruding portions, or the height of each of the protruding portions. That is, the volume of the recessed portions per unit area of the medium holding surface in the width direction is changed by a combination of the interval between the protruding portions and the area and height of the surface, which comes into contact with the medium, of each of the protruding portions.

(9) The medium conveying device according to any one of (1) to (8), in which projections, which protrude from the medium holding surface, are regularly disposed as the protruding portions, so that the recessed portions and the protruding portions are formed.

According to this aspect, the projections are regularly disposed as the protruding portions, so that the recessed portions and the protruding portions are formed on the medium holding surface. The recessed portions are regularly disposed, so that the recessed portions and the protruding portions can be formed on the medium holding surface. However, since the projections, which protrude from the medium holding surface, are regularly disposed as the protruding portions, so that the recessed portions and the protruding portions are formed, a medium can be easily made to be even when being made to be even by the pressing unit.

(10) The medium conveying device according to (9), in which the projection has a columnar shape.

According to this aspect, the projections having a columnar shape are regularly disposed on the medium holding surface, so that the recessed portions and the protruding portions are formed on the medium holding surface.

(11) The medium conveying device according to (10), in which the projection has the shape of a column of which an outer peripheral edge of an end is chamfered.

According to this aspect, the outer peripheral edge of the end of the projection having a columnar shape is chamfered. Accordingly, when a medium is pressed by the pressing unit, the medium is more easily made to be even.

(12) The medium conveying device according to any one of (1) to (11), in which the conveying unit is a rotating drum, and the peripheral surface of the drum is the medium holding surface.

According to this aspect, the conveying unit is formed of a rotating drum. A medium is conveyed while being held on the peripheral surface of the drum.

(13) The medium conveying device according to any one of (1) to (10), in which the conveying unit is an endless belt that travels along a fixed path, and the peripheral surface of the belt forms the medium holding surface.

According to this aspect, the conveying unit is formed of an endless belt that travels along a fixed path. A medium is conveyed while being held on the peripheral surface of the belt.

(14) An image recording apparatus comprising: the medium conveying device according to any one of (1) to (13); and an image recording unit for recording an image on the medium conveyed by the medium conveying device.

According to this aspect, in the image recording apparatus, a medium is conveyed by the medium conveying device according to any one of (1) to (12).

(15) The image recording apparatus according to (14), in which the image recording unit records an image by an ink jet method.

According to this aspect, in the image recording apparatus using the ink jet method, a medium is conveyed by the medium conveying device according to any one of (1) to (12). Accordingly, a high-quality image can be recorded on a medium. Further, a contact between a print head and a medium can be prevented.

According to the invention, it is possible to convey a medium without the generation of wrinkles and floating.

DESCRIPTION OF THE PREFERRED EMBODIMENTS

Embodiments of the invention will be described in detail below with reference to accompanying drawings.

Entire Structure of Image Recording Apparatus

Figure 1:
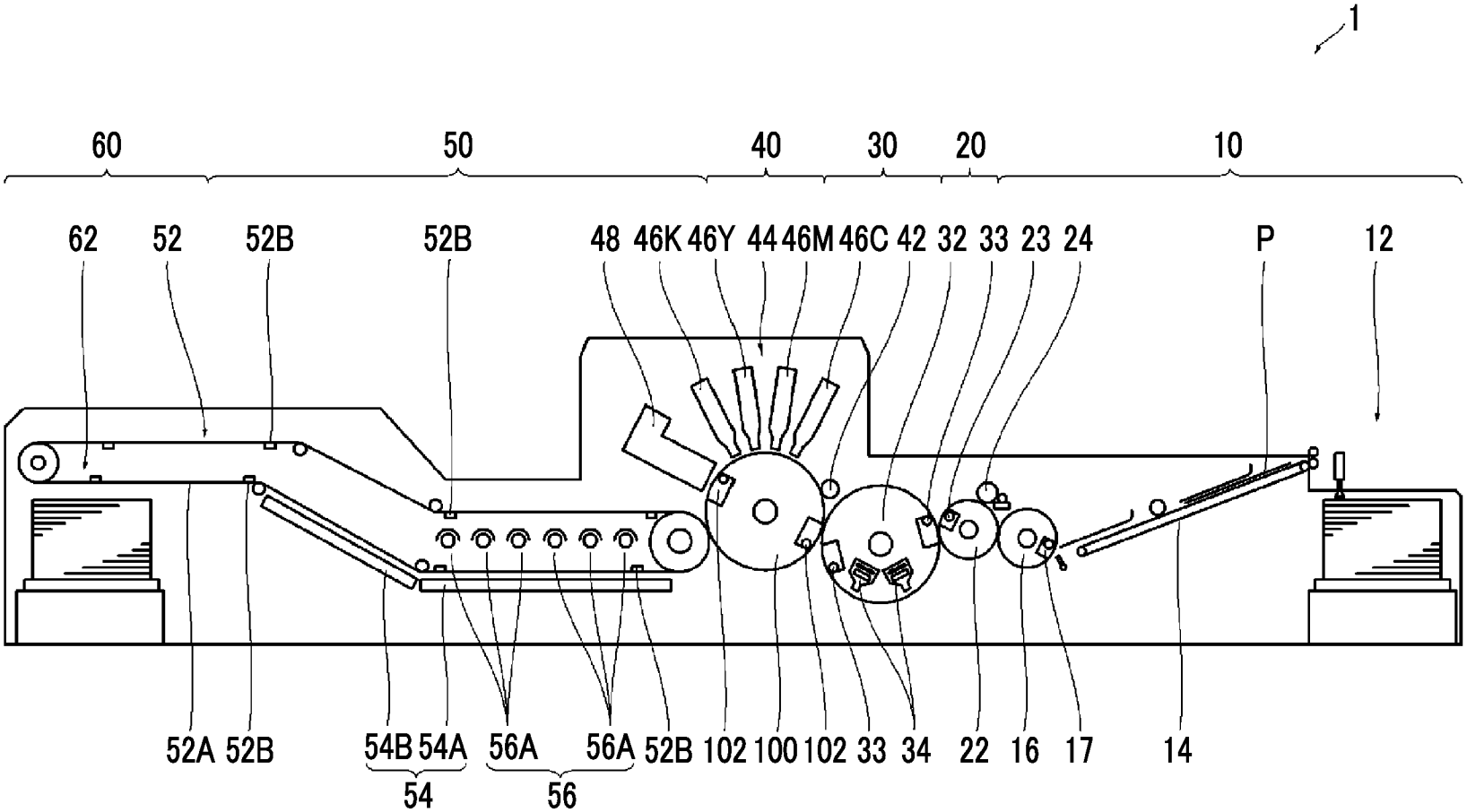
FIG. 1 is a view showing the entire structure of an embodiment of an image recording apparatus.

FIG. 1 is a view showing the entire structure of an embodiment of an image recording apparatus. The image recording apparatus 1 is a sheet-feed type ink jet printing machine that prints an image on a sheet of paper (hereinafter, referred to as a sheet), which is a sheet-like medium, by an ink jet method. Particularly, the image recording apparatus 1 is a sheet-feed type color ink jet printing machine that prints a color image on a general-purpose printing sheet by using aqueous ink.

The general-purpose printing sheet is not so-called ink jet exclusive paper and means a sheet, which uses cellulose as a main component, such as coated paper (art paper, coated paper, lightweight coated paper, cast coated paper, fine coated paper, or the like) that is used in offset printing or the like. Further, the aqueous ink means ink in which a color material, such as a dye or a pigment, is dissolve or dispersed in water and a solvent soluble in water.

As shown in FIG. 1, the image recording apparatus 1 mainly includes: a sheet feeding section 10 that feeds a sheet P; a treatment liquid applying section 20 that applies predetermined treatment liquid to the sheet P fed from the sheet feeding section 10; a treatment liquid drying section 30 that performs processing for drying the sheet P to which the treatment liquid has been applied; an image recording section 40 that records an image on the sheet P, which has been subjected to drying processing, by an ink jet method; an ink drying section 50 that performs processing for drying the sheet P on which the image has been recorded; and a collection section 60 that collects the sheet P having been subjected to drying processing.

Sheet Feeding Section

The sheet feeding section 10 feeds sheets (sheets of paper) P, which are sheet-like media, one by one. As shown in FIG. 1, the sheet feeding section 10 mainly includes a sheet feeding device 12, a feeder board 14, and a sheet feed drum 16.

The sheet feeding device 12 sequentially takes out the sheets P, which are set at a predetermined position in the form of a sheet bundle, from the top of the sheet bundle one by one and feeds the sheets P to the feeder board 14 one by one.

The feeder board 14 receives the sheets P that are fed from the sheet feeding device 12 one by one, conveys the received sheets P along a predetermined conveying path, and transfers the sheets P to the sheet feed drum 16.

The sheet feed drum 16 receives the sheets P fed from the feeder board 14, conveys the received sheets P along a predetermined conveying path, and transfers the sheets P to the treatment liquid applying section 20. The sheet feed drum 16 has a cylindrical shape, and grips a front end portion of the sheet P in a conveying direction by a gripper 17, which is provided on the peripheral surface of the sheet feed drum 16, and rotates. Accordingly, the sheet feed drum 16 conveys the sheet P while winding the sheet P around the peripheral surface thereof.

Treatment Liquid Applying Section

The treatment liquid applying section 20 applies predetermined treatment liquid to the image recording surface of the sheet P. The treatment liquid, which is applied by the treatment liquid applying section 20, is liquid having a function to allow a color material component, which is contained in ink, to aggregate, to insolubilize the color material component, or to thicken the color material component. Since the treatment liquid is applied to the sheet, a high-quality image can be recorded even in a case in which an image is recorded on a general-purpose printing sheet by an ink jet method.

As shown in FIG. 1, the treatment liquid applying section 20 mainly includes a treatment liquid applying drum 22 that conveys a sheet P, and a treatment liquid applying device 24 that applies treatment liquid to the image recording surface of the sheet P conveyed by the treatment liquid applying drum 22.

The treatment liquid applying drum 22 receives the sheet P from the sheet feed drum 16 of the sheet feeding section 10, conveys the received sheet P along a predetermined conveying path, and transfers the sheet P to the treatment liquid drying section 30. The treatment liquid applying drum 22 has a cylindrical shape, and grips a front end portion of the sheet P in a conveying direction by a gripper 23, which is provided on the peripheral surface of the treatment liquid applying drum 22, and rotates. Accordingly, the treatment liquid applying drum 22 conveys the sheet P while winding the sheet P around the peripheral surface thereof. The sheet P is conveyed while being wound around the peripheral surface of the treatment liquid applying drum 22 in a state in which the image recording surface of the sheet P faces the outside.

The treatment liquid applying device 24 applies treatment liquid to the surface of the sheet P that is conveyed by the treatment liquid applying drum 22. In this embodiment, treatment liquid is applied by a roller. That is, a roller (applying roller) to which treatment liquid has been applied to the peripheral surface thereof is pressed against the image recording surface of the sheet P conveyed by the treatment liquid applying drum 22, so that the treatment liquid is applied to the sheet. A method of applying treatment liquid is not limited thereto, and a method of applying treatment liquid by using an ink jet head, a method of applying treatment liquid by using a spray, and the like can also be employed besides the above-mentioned method.

The treatment liquid applying section 20 has the above-mentioned structure. While a sheet P is conveyed by the treatment liquid applying drum 22, treatment liquid is applied to the image recording surface of the sheet P.

Treatment Liquid Drying Section

The treatment liquid drying section 30 performs processing for drying the sheets P to which treatment liquid has been applied. The treatment liquid drying section 30 mainly includes a treatment liquid drying drum 32 that conveys sheets P, and treatment liquid drying devices 34 that dry the sheets P by blowing hot air to the sheets P conveyed by the treatment liquid drying drum 32.

The treatment liquid drying drum 32 receives the sheet P from the treatment liquid applying drum 22 of the treatment liquid applying section 20, conveys the received sheet P along a predetermined conveying path, and transfers the sheet P to the image recording section 40. The treatment liquid drying drum 32 is formed of a frame body formed in a cylindrical shape, and grips front end portions of the sheets P in a conveying direction by grippers 33, which are provided on the peripheral surface of the treatment liquid drying drum 32, and rotates. Accordingly, the treatment liquid drying drum 32 conveys the sheets P.

The treatment liquid drying devices 34 are installed in the treatment liquid drying drum 32, and send hot air to the sheets P conveyed by the treatment liquid drying drum 32.

The treatment liquid drying section 30 has the above-mentioned structure. While sheets P are conveyed by the treatment liquid drying drum 32, hot air is blown to the surfaces of the sheets to which treatment liquid has been applied and the sheets are subjected to drying processing.

Image Recording Section

The image recording section 40 records a color image on the image recording surface of the sheet P with ink having four colors of cyan (C), magenta (M), yellow (Y), and black (K) by an ink jet method. As shown in FIG. 1, the image recording section 40 mainly includes: an image recording drum 100 that conveys sheets P; a pressing roller 42 that makes each sheet P come into close contact with (be held on) the peripheral surface of the image recording drum 100 by pressing each sheet P, which is conveyed by the image recording drum 100, against the peripheral surface of the image recording drum 100; a head unit 44 that records a color image on each sheet P by discharging ink droplets having colors of C, M, Y, and K to the sheet P conveyed by the image recording drum 100; and a scanner 48 that reads the image recorded on the sheet P.

The image recording drum 100 is an example of a conveying unit. The image recording drum 100 receives the sheets P from the treatment liquid drying drum 32 of the treatment liquid drying section 30, conveys the received sheets P along a predetermined conveying path, and transfers the sheets P to the ink drying section 50. The image recording drum 100 has a cylindrical shape, grips ends of the sheets P by grippers 102, which are provided on the peripheral surface of the image recording drum 100, and rotates. Accordingly, the image recording drum 100 conveys the sheets P while winding the sheets P around the peripheral surface thereof that is a medium holding surface.

Further, the image recording drum 100 is provided with a suction mechanism to fix the sheets P, which are being conveyed, on the drum. In the image recording drum 100 of this embodiment, a sheet P is sucked using negative pressure. The image recording drum 100 includes a plurality of suction holes on the peripheral surface thereof that is the medium holding surface, and sucks and fixes the sheets P on the peripheral surface thereof by sucking air from the inside of the drum through the suction holes.

The pressing roller 42 is an example of a pressing unit. The pressing roller 42 makes the sheet P come into close contact with (be held on) the peripheral surface of the image recording drum 100 by pressing the sheet P, which is conveyed by the image recording drum 100, against the peripheral surface of the image recording drum 100. The pressing roller 42 is formed of a rubber roller that has a width corresponding to the image recording drum 100. The pressing roller 42 is disposed immediately behind a position where the image recording drum 100 receives the sheet P from the treatment liquid drying drum 32. Accordingly, while the sheet P is pressed against the peripheral surface of the image recording drum 100 by the pressing roller 42, the sheet P is wound around the peripheral surface of the image recording drum 100.

In the image recording apparatus 1 of this embodiment, the image recording drum 100 and the pressing roller 42 form a medium conveying device. The detail of the medium conveying device will be described in detail below.

The head unit 44 is an image recording unit in a broad sense; and includes an ink jet head 46C that discharges cyan ink droplets, an ink jet head 46M that discharges magenta ink droplets, an ink jet head 46Y that discharges yellow ink droplets, and an ink jet head 46K that discharges black ink droplets. The respective ink jet heads 46C, 46M, 46Y, and 46K are disposed on the conveying path of the sheet P conveyed by the image recording drum 100.

Each of the ink jet heads 46C, 46M, 46Y, and 46K is an image recording unit in a narrow sense, and is formed of a line head that can record an image on the sheet P, which is conveyed by the image recording drum 100, through a single pass. Each of the ink jet heads 46C, 46M, 46Y, and 46K includes a nozzle surface at the tip thereof, and discharges ink droplets to the sheet P, which is conveyed by the image recording drum 100, from nozzles disposed on the nozzle surface.

As shown in FIG. 1, the scanner 48 is installed on the downstream side of the head unit 44 in the conveying direction of the sheet P that is conveyed by the image recording drum 100. The scanner 48 reads the image that is recorded on the sheet P by the head unit 44.

The image recording section 40 has the above-mentioned structure. While a sheet P is conveyed by the image recording drum 100, ink droplets having the respective colors of C, M, Y, and K are ejected to the image recording surface of the sheet P from the respective ink jet heads 46C, 46M, 46Y, and 46K of the head unit 44. As a result, a color image is recorded on the image recording surface of the sheet P. The image recorded on the sheet P is read by the scanner 48 as necessary.

Ink Drying Section

The ink drying section 50 performs processing for drying the sheet P on which the image has just been recorded by the image recording section 40. As shown in FIG. 1, the ink drying section 50 mainly includes a chain gripper 52 that conveys a sheet P, a sheet guide 54 that guides the travel of the sheet P conveyed by the chain gripper 52, and a heating-drying device 56 that dries the image recording surface of the sheet P, which is conveyed by the chain gripper 52, by heating the image recording surface of the sheet P.

The chain gripper 52 receives the sheet P from the image recording drum 100 of the image recording section 40, conveys the received sheet P along a predetermined conveying path, and transfers the sheet P to the collection section 60. The chain gripper 52 includes an endless chain 52A that travels along a fixed travel path, grips an end of the sheet P by grippers 52B provided on the chain 52A, and conveys the sheet P. Since the sheet P is conveyed by the chain gripper 52, the sheet P passes through a heating region and a non-heating region set in the ink drying section 50 and is transferred to the collection section 60. The heating region is set to a region in which the sheet P transferred from the image recording section 40 is horizontally conveyed for the first time, and the non-heating region is set to a region in which the sheet P is conveyed obliquely.

The sheet guide 54 is disposed along the conveying path of the sheet P that is conveyed by the chain gripper 52, and guides the travel of the sheet P that is conveyed by the chain gripper 52. The sheet guide 54 includes a first guide board 54A and a second guide board 54B.

The first guide board 54A is a guide board that is disposed in the heating region, and has the shape of a hollow flat plate. The upper surface portion of the first guide board 54A functions as the guide surface for the sheet P, and the sheet P is conveyed while sliding on the guide surface.

A plurality of suction holes are provided on the guide surface of the first guide board 54A. Since the first guide board 54A sucks air from the inside thereof through the suction holes by negative pressure, the first guide board 54A guides the travel of the sheet P while sucking the sheet P on the guide surface.

Further, the first guide board 54A is provided with a cooling mechanism that cools the guide surface. The cooling mechanism is formed of, for example, a water-cooled cooling mechanism, and cools the guide surface by allowing cooling liquid to flow in a flow passage provided therein. The temperature of the guide surface of the first guide board 54A is controlled to a constant temperature by the cooling mechanism.

The second guide board 54B is a guide board that is disposed in the non-heating region. The structure of the second guide board 54B is the same as the structure of the first guide board 54A. That is, the second guide board 54B has the shape of a hollow flat plate, and guides the travel of the sheet P while sucking the sheet P on the guide surface. Furthermore, the second guide board 54B is provided with a cooling mechanism, and the temperature of the guide surface of the second guide board 54B is controlled to a constant temperature by the cooling mechanism.

The heating-drying device 56 is installed in the heating region, and dries the image recording surface of the sheet P, which is being conveyed in the heating region, by heating the image recording surface of the sheet P with radiant heat that is emitted from a heat source. The heating-drying device 56 includes a plurality of infrared lamps 56A serving as heat sources, and is disposed inside the chain gripper 52. The infrared lamps 56A are disposed in the heating region at regular intervals in the conveying path of the sheet P.

The ink drying section 50 has the above-mentioned structure. While a sheet P is conveyed by the chain gripper 52, the image recording surface of the sheet P is heated by the heating-drying device 56 and the sheet is subjected to drying processing.

Collection Section

The collection section 60 collects sheets P, which are sequentially discharged, in one place. As shown in FIG. 1, the collection section 60 mainly includes a collection device 62 that receives and collects sheets P conveyed from the ink drying section 50 by the chain gripper 52.

The chain gripper 52 releases sheets P at a predetermined collection position. The collection device 62 recovers the released sheets P and collects the released sheets P in the form of a bundle.

Flow of Processing for Recording Image

Processing for recording an image is performed in the order of (a) the feeding of a sheet, (b) the applying of treatment liquid, (c) drying, (d) the recording of an image, (e) drying, and (f) collecting.

When the start of the recording of an image is instructed, a sheet starts to be fed from the sheet feeding section 10. First, the sheet P, which is fed from the sheet feeding section 10, is conveyed to the treatment liquid applying section 20. Then, while the sheet P is conveyed by the treatment liquid applying drum 22 of the treatment liquid applying section 20, treatment liquid is applied to the image recording surface of the sheet P.

Next, the sheet P to which treatment liquid has been applied is conveyed to the treatment liquid drying section 30. Then, while the sheet P is conveyed by the treatment liquid drying drum 32 of the treatment liquid drying section 30, hot air is blown to the image recording surface of the sheet P and the sheet P is subjected to drying processing.

Next, the sheet P, which has been subjected to drying processing, is conveyed to the image recording section 40. Then, while the sheet P is conveyed by the image recording drum 100 of the image recording section 40, ink droplets having the respective colors of cyan, magenta, yellow, and black are ejected and a color image is recorded on the image recording surface of the sheet P.

Next, the sheet P on which the image has been recorded is conveyed to the ink drying section 50. Then, while the sheet P is conveyed by the chain gripper 52 of the ink drying section 50, heat emitted from the infrared lamps 56A is applied to the image recording surface of the sheet P and the sheet P is subjected to drying processing.

The sheet P, which has been subjected to drying processing, is conveyed to the collection section 60 by the chain gripper 52 just as it is, and is recovered by the collection device 62 of the collection section 60.

Structure of Medium Conveying Device

First Embodiment

[Structure]

As described above, in the image recording apparatus 1 of this embodiment, the medium conveying device according to the invention is used as means for conveying a sheet (medium) P in the image recording section 40. Further, in the image recording apparatus 1 of this embodiment, the medium conveying device includes the image recording drum 100 serving as a conveying unit and the pressing roller 42 serving as a pressing unit.

Figure 2:
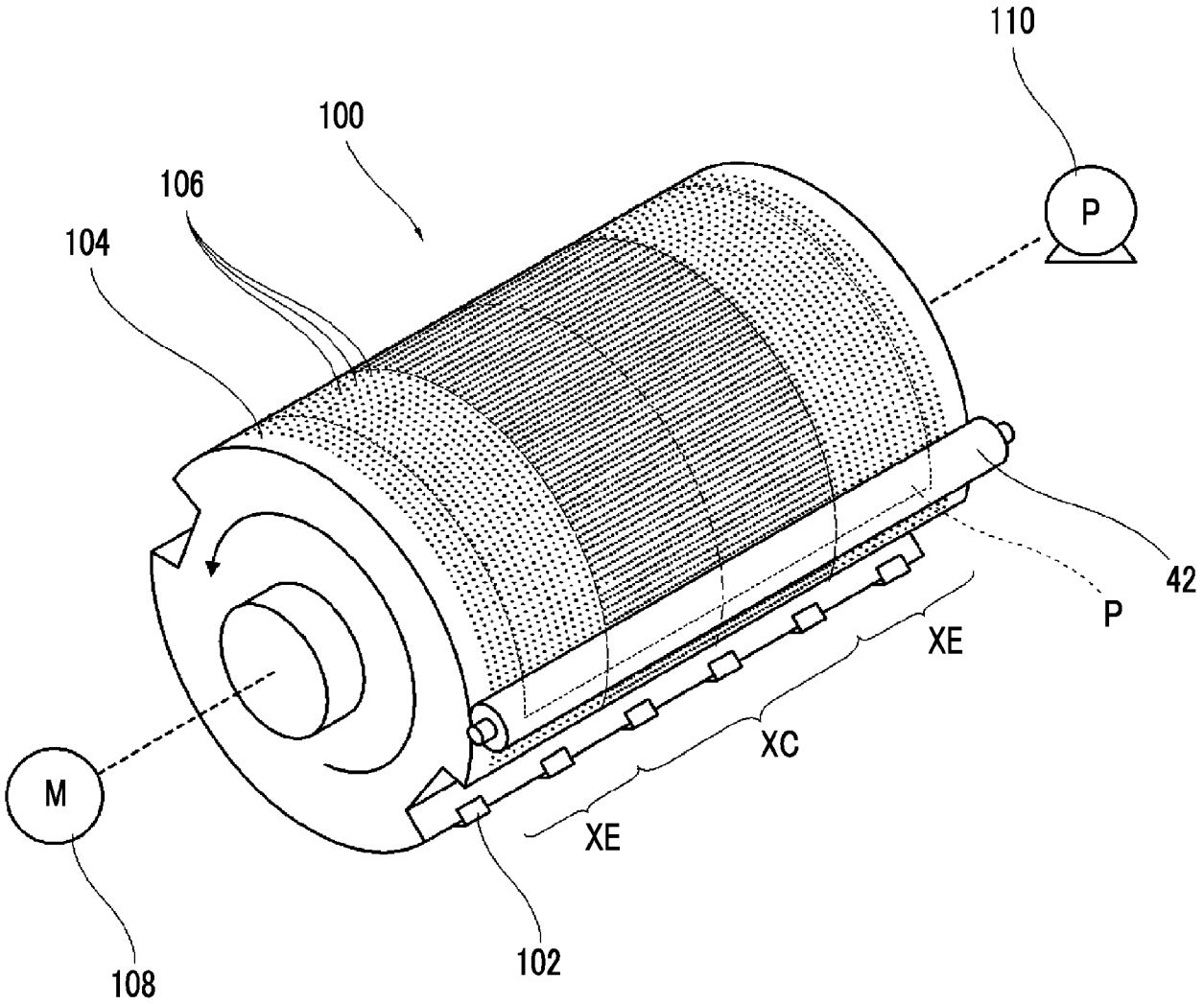
FIG. 2 is a perspective view showing the structure of a first embodiment of a medium conveying device.

FIG. 2 is a perspective view showing the structure of a first embodiment of the medium conveying device.

The image recording drum 100 has a cylindrical shape, and conveys sheets P by rotating while winding the sheets P around the peripheral surface 104 thereof that is the medium holding surface. The image recording drum 100 is installed in the image recording section 40 so that a shaft portion of the image recording drum 100 is supported by bearings (not shown). The image recording drum 100, which is installed in the image recording section 40, is connected to a motor 108 serving as a driving unit, and is rotated by rotational power obtained from the motor 108. That is, the peripheral surface 104, which is the medium holding surface, is moved.

The grippers 102 are provided at two positions on the outer peripheral surface of the image recording drum 100. Ends of sheets P are gripped by the grippers 102.

A plurality of suction holes are regularly disposed on the peripheral surface 104 of the image recording drum 100 that is the medium holding surface. Since air is sucked from the inside of the image recording drum 100 through the suction holes, the sheets P are sucked and held on the peripheral surface 104. A vacuum flow passage (not shown), which communicates with the suction holes, is provided in the image recording drum 100. The vacuum flow passage is connected to a vacuum pump 110, which is installed outside the image recording drum 100, through the shaft portion of the image recording drum 100. When the vacuum pump 110 is driven, the image recording drum 100 sucks air from the respective suction holes.

A range in which the sheet P is sucked from the suction holes is limited to a constant angular range, and the image recording drum 100 is adapted to suck the sheet P in a range between the installation position of the pressing roller 42 and a delivery position for the sheet P on the image recording drum 100 (a position where the image recording drum 100 delivers the sheet P to the chain gripper 52).

Further, a plurality of projections 106 are regularly disposed on the peripheral surface 104, so that recessed portions and protruding portions are formed on the peripheral surface 104. Since the recessed portions and the protruding portions are formed on the peripheral surface 104, the deformation of the sheet P can be absorbed by the recessed portions and the protruding portions. Accordingly, the sheet P can be made to come into close contact with (be held on) the peripheral surface of the image recording drum 100 without the generation of wrinkles and floating. This will be described in detail below.

The pressing roller 42 presses the sheet P, which is wound around the peripheral surface 104 of the image recording drum 100, against the peripheral surface 104 of the image recording drum 100 and makes the sheet P come into close contact with (be held on) the peripheral surface 104. The pressing roller 42 is disposed between the receiving position for the sheet P on the image recording drum 100 (a position where the image recording drum 100 receives the sheet P from the treatment liquid drying drum 32) and the ink jet head 46C positioned on the uppermost stream side. The pressing roller 42 is formed of a rubber roller that is a roller of which at least the outer peripheral portion is made of an elastic body, such as rubber. The pressing roller 42 is disposed in parallel to the image recording drum 100, and installed so as to come into pressure contact with the peripheral surface 104 of the image recording drum 100.

When the sheet P of which an end is gripped by the gripper 102 passes through the installation position of the pressing roller 42, the sheet P is pressed against the peripheral surface 104 of the image recording drum 100 by the pressing roller 42 and comes into close contact with (is held on) the peripheral surface 104 of the image recording drum 100.

Figure 3:
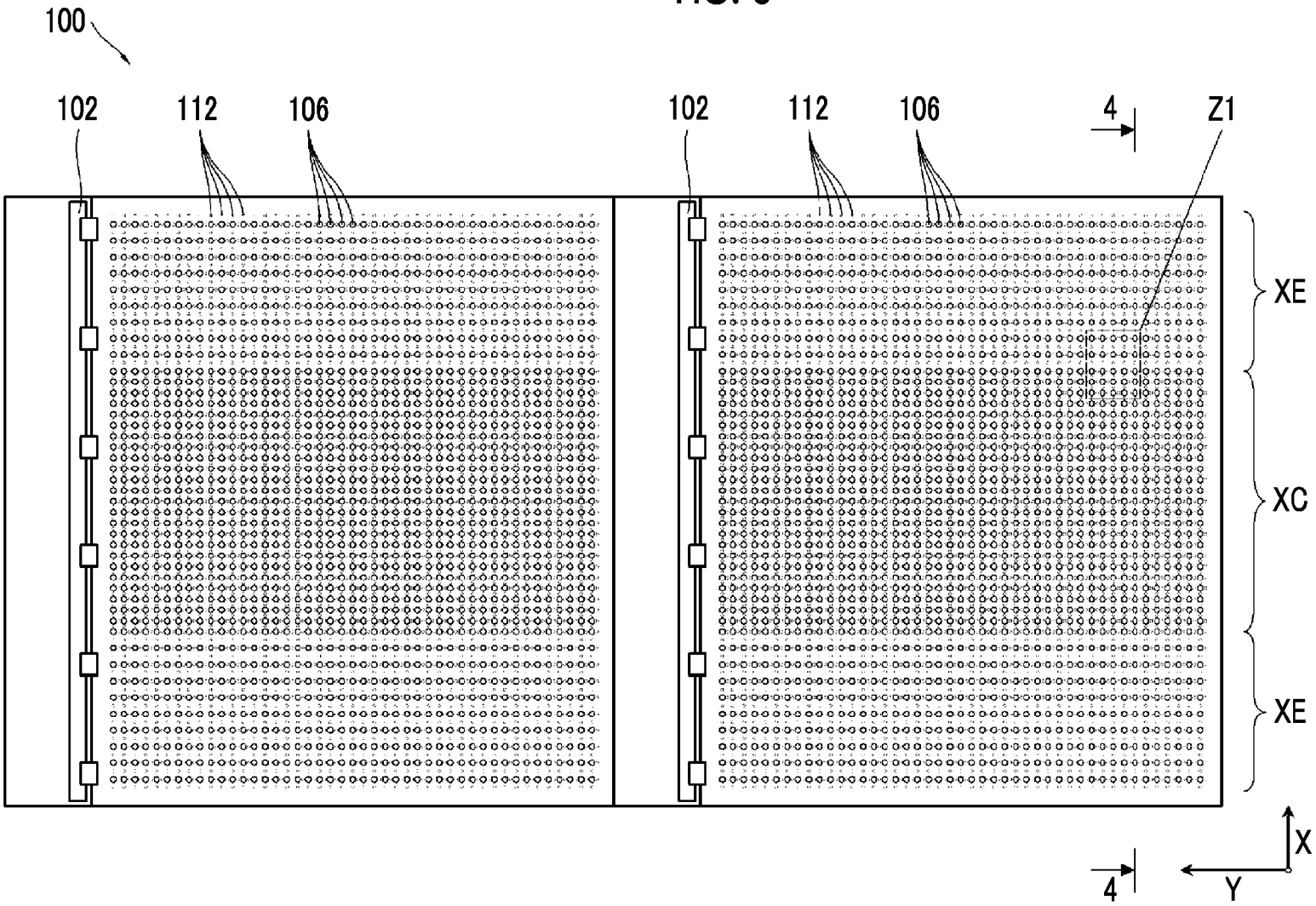
FIG. 3 is a development view showing the structure of the peripheral surface of an image recording drum.
Figure 4:
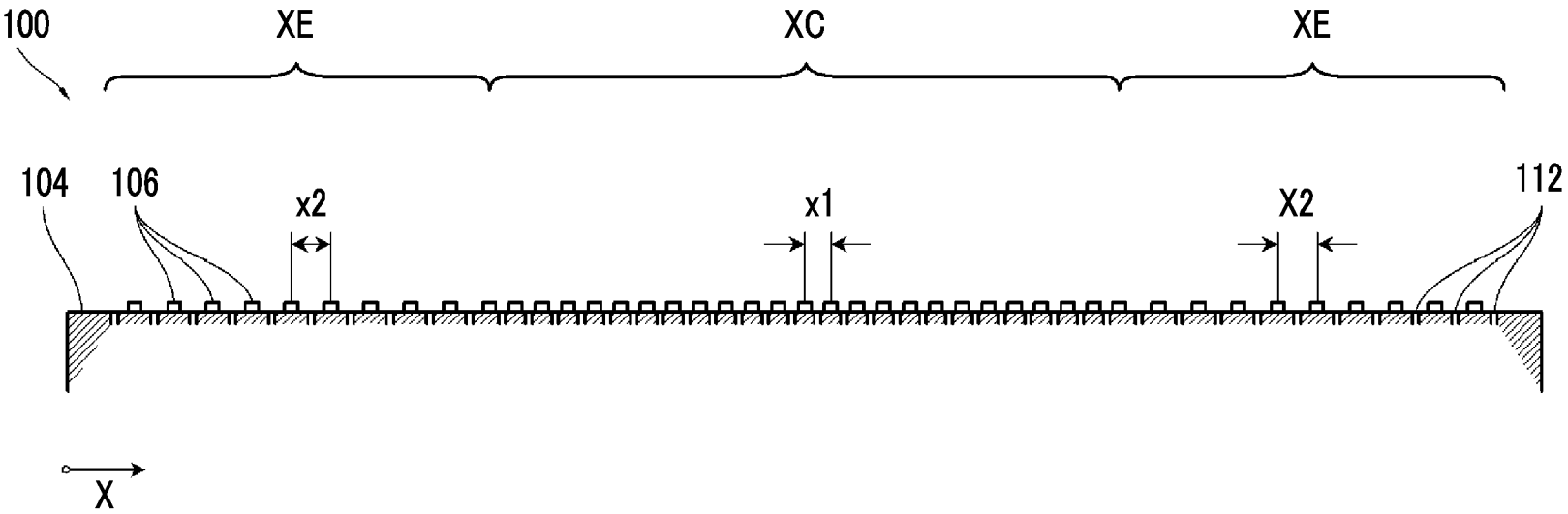
FIG. 4 is a cross-sectional view taken along line 4-4 of FIG. 3.
Figure 5:
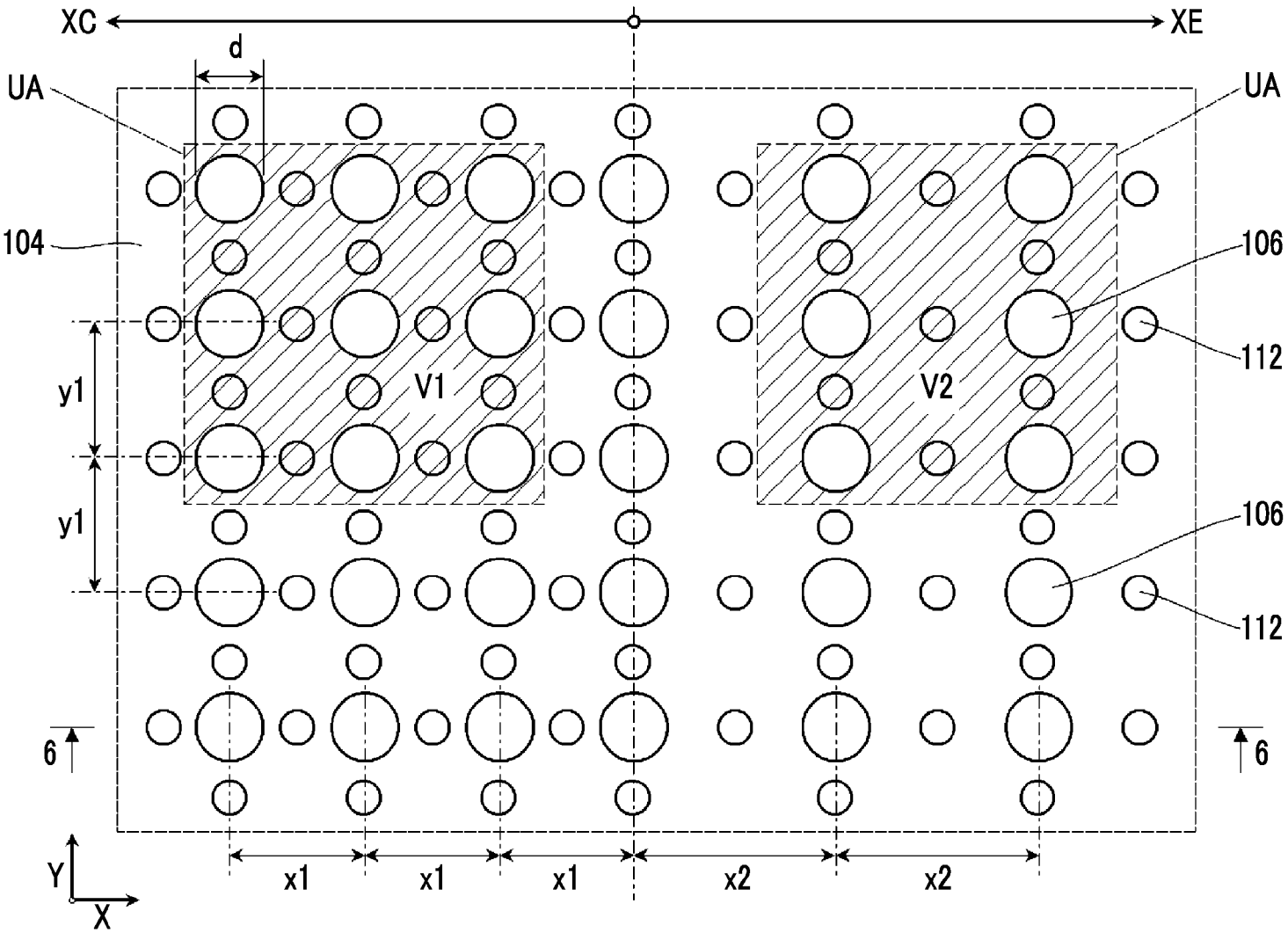
FIG. 5 is an enlarged view of a part (a region Z1 surrounded by a broken line) of FIG. 3.
Figure 6:
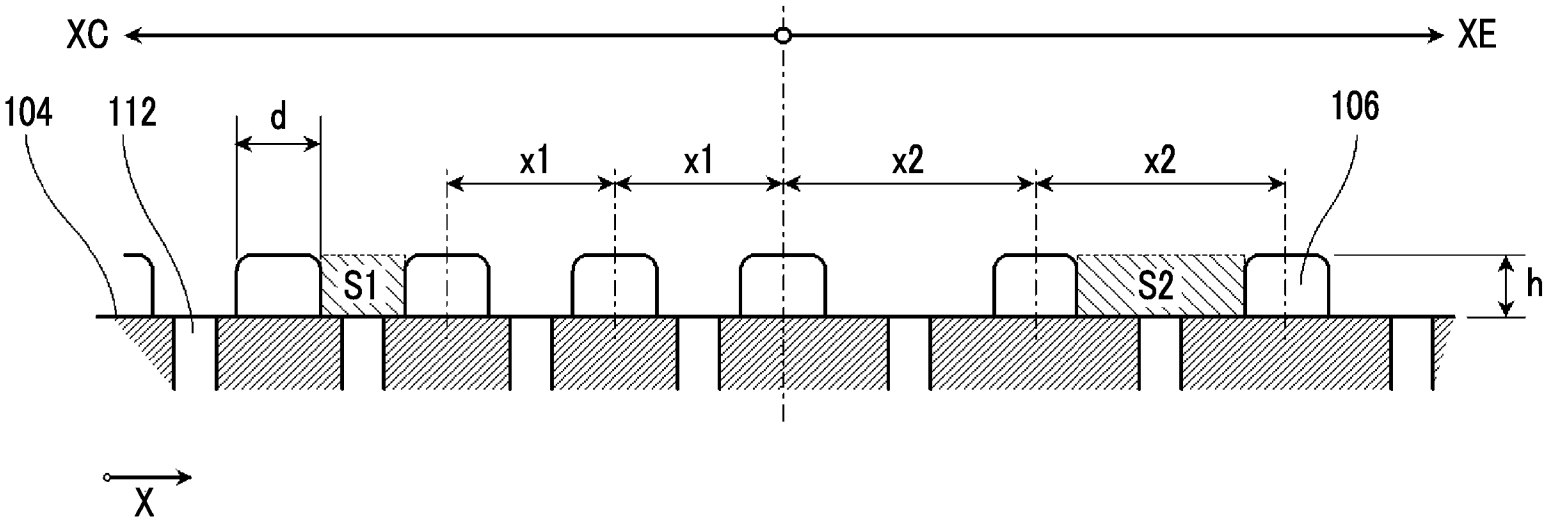
FIG. 6 is a cross-sectional view taken along line 6-6 of FIG. 5.
Figure 7:
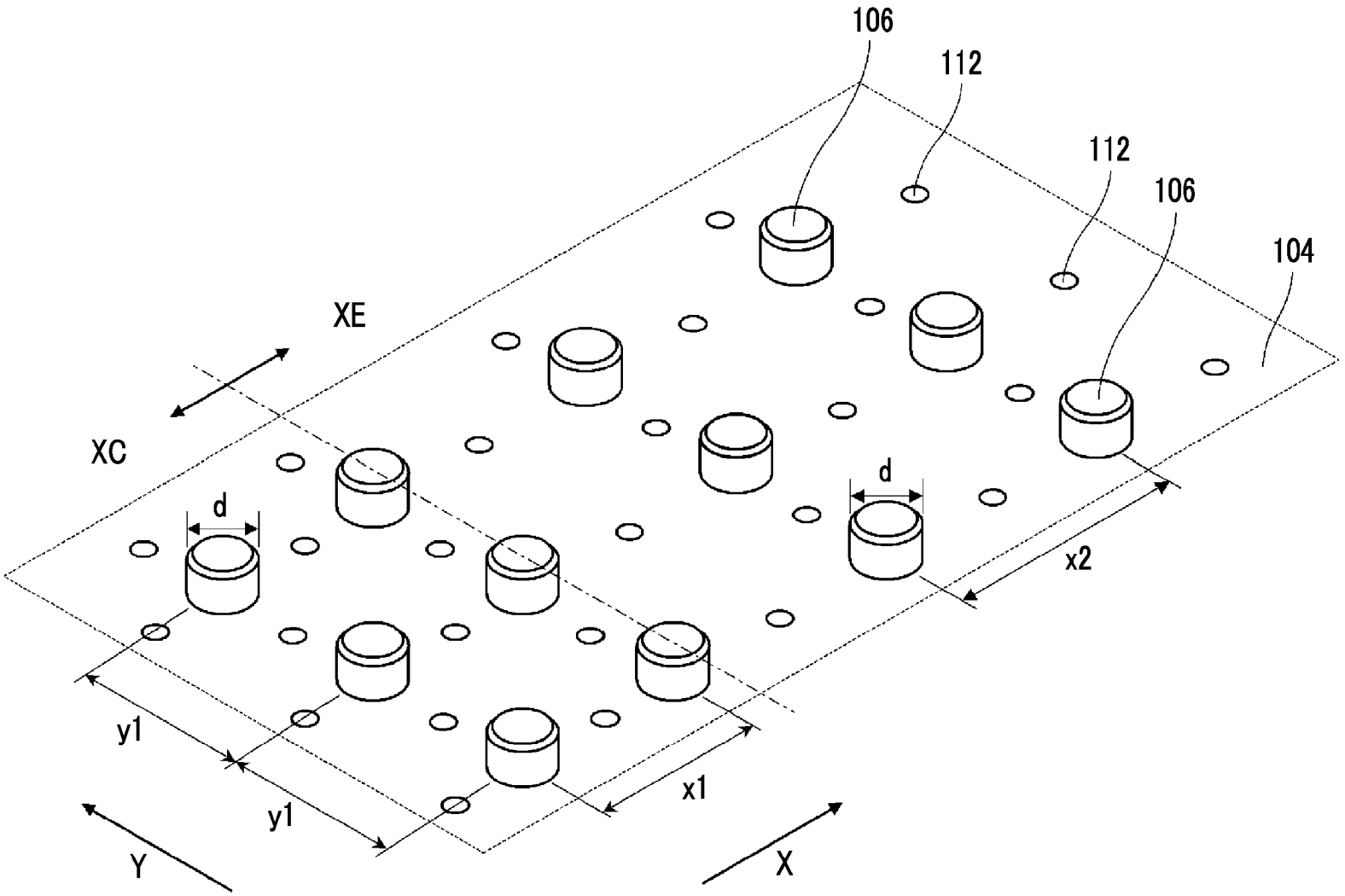
FIG. 7 is a perspective view of FIG. 5.

FIG. 3 is a development view showing the structure of the peripheral surface of the image recording drum. FIG. 4 is a cross-sectional view taken along line 4-4 of FIG. 3. FIG. 5 is an enlarged view of a part (a region Z1 surrounded by a broken line) of FIG. 3. FIG. 6 is a cross-sectional view taken along line 6-6 of FIG. 5. FIG. 7 is a perspective view of FIG. 5.

Columnar projections 106 are regularly disposed on the peripheral surface 104 of the image recording drum 100 as shown in FIGS. 3 to 7, so that recessed portions and protruding portions are formed on the peripheral surface 104. That is, the projection 106 forms the protruding portion and the recessed portion is formed between the projections 106, so that the recessed portions and the protruding portions having a predetermined shape are formed.

All the projections 106 have the same size, that is, the same diameter d and the same height h, and are regularly disposed according to a predetermined arrangement rule. The arrangement rule is set as follows. That is, the conveying direction of the sheet P is set as a Y direction and a width direction, which is a direction orthogonal to the conveying direction, is set as an X direction. The projections 106 are disposed at regular intervals y1 in the conveying direction (the Y direction). The projections 106 are disposed at different intervals at a middle portion and both end portions in the width direction (the X direction). That is, as shown in FIGS. 5 and 6, the projections 106 are disposed at regular intervals x1 in a middle region XC, which is set in the middle so as to have a constant width, and the projections 106 are disposed at intervals x2 (x2>x1), which are wider than the intervals x1, in both end regions XE that are set on both sides of the middle region XC so as to have a constant width. In other words, the projections 106 are densely disposed in the middle region XC and the projections 106 are sparsely disposed in both the end regions XE.

When an interval between adjacent projections (protruding portions) 106 is changed as described above, the size of the recessed portion formed between adjacent projections 106 is changed. In this embodiment, the recessed portions formed in both the end regions XE are wider than the recessed portions formed in the middle region XC since an interval between the projections 106 disposed in both the end regions XE is larger than an interval between the projections 106 disposed in the middle region XC. In this case, when a cross-section at the positions where the projections 106 are disposed is taken in the width direction (the X direction), the cross-sectional area S2 of each of the recessed portions formed in both the end regions XE is larger than the cross-sectional area S1 of each of the recessed portions formed in the middle region XC (S1<S2) as shown in FIG. 6. Further, when a relationship of the volume of the recessed portion formed between adjacent projections 106 is taken, the volume of each of the recessed portions formed in the both end regions XE is larger than the volume of each of the recessed portions formed in the middle region XC.

As a result, in regard to the volume of the recessed portions per unit area UA, the volume V2 of the recessed portions per unit area UA in both the end regions XE is larger than the volume V1 of the recessed portions per unit area UA in the middle region XC as shown in FIG. 5. In other words, the sum of the volumes of the recessed portions formed in both the end regions XE is larger than the sum of the volumes of the recessed portions formed in the middle region XC.

In this embodiment, the interval y1 between the projections 106 disposed in the conveying direction (the Y direction) is equal to the interval x1 between the projections 106 in the middle region XC in the width direction (the X direction) (y1=x1).

Suction holes 112 are disposed between the projections in the conveying direction (the Y direction) and the width direction (the X direction). That is, each of the suction holes 112 is disposed in the recessed portion. More specifically, each suction hole 112 is disposed at an intermediate position between the projections 106 arranged in the conveying direction (the Y direction), and each suction hole 112 is disposed at an intermediate position between the projections 106 arranged in the width direction (the X direction).

[Action]

As described above, the projections 106 are disposed on the peripheral surface 104 of the image recording drum 100 that is the medium holding surface, so that the recessed portions and the protruding portions are formed on the peripheral surface 104. Further, the recessed portions and the protruding portions have a shape in which the volume of the recessed portions per unit area at both the end portions is larger than the volume of the recessed portions per unit area at the middle portion in the width direction (the X direction) that is a direction orthogonal to the conveying direction of the sheet P (the Y direction). Accordingly, the following action is obtained.

That is, the projections 106 are disposed on the peripheral surface 104 and form the recessed portions and the protruding portions on the peripheral surface 104. Accordingly, since the deformation of a sheet P can be absorbed by the recessed portions even in a case in which the sheet P is deformed, the generation of wrinkles and floating can be prevented.

Furthermore, since an interval between the projections 106 is widened at both the end portions in the width direction (the X direction), the generation of wrinkles and floating can be prevented even in a case in which local deformation is generated in the plane of a sheet P. This will be further described in detail below.

Figure 8B:
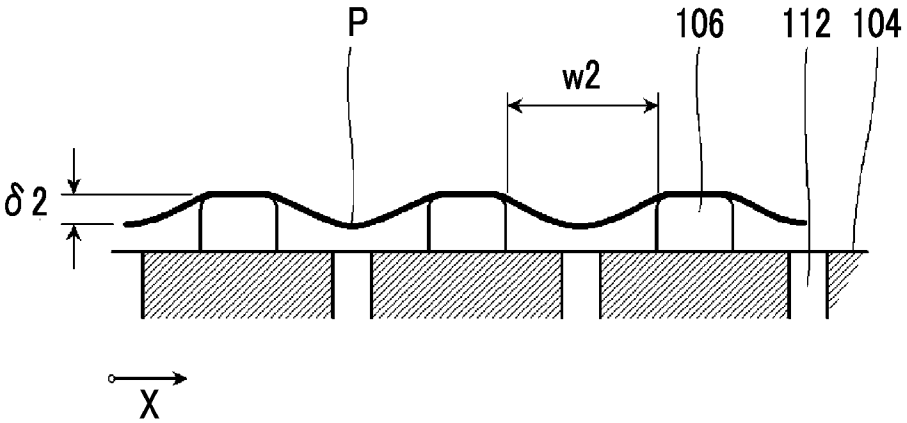
FIGS. 8A and 8B are views showing a state in which the deformation of a sheet is absorbed by recessed portions formed on the peripheral surface.
Figure 8A:
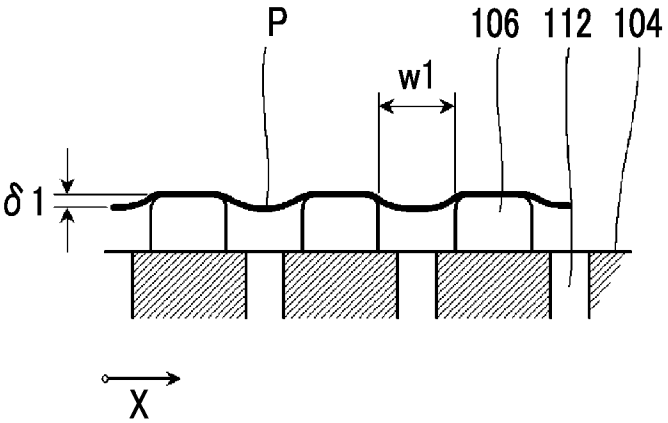

FIGS. 8A and 8B are views showing a state in which the deformation of a sheet is absorbed by the recessed portions. FIG. 8A shows a state in which the deformation of the sheet P is absorbed in the middle region XC, and FIG. 8B shows a state in which the deformation of the sheet P is absorbed in both the end regions XE.

As described above, the sheet P comes into close contact with (is held on) the peripheral surface 104 of the image recording drum 100 while being pressed against the peripheral surface 104 of the image recording drum 100 by the pressing roller 42. In this case, the length of the bent arc (the length of the curved arc) of the sheet P, which is pressed against the peripheral surface 104, in both the end regions XE is larger than that in the middle region XC as shown in FIGS. 8A and 8B. That is, since an interval between the projections 106 in both the end regions XE is wider than that in the middle region XC in the image recording drum 100 of this embodiment, the length of the bent arc of the sheet P in both the end regions XE is larger than that in the middle region XC when the sheet P is pressed by the pressing roller 42. As a result, the amount δ2 of bending of the sheet in both the end regions XE is larger than the amount δ1 of bending of the sheet in the middle region XC. In other words, the amount of deformation of the sheet P that can be absorbed in both the end regions XE is larger than that in the middle region XC.

Figure 9:
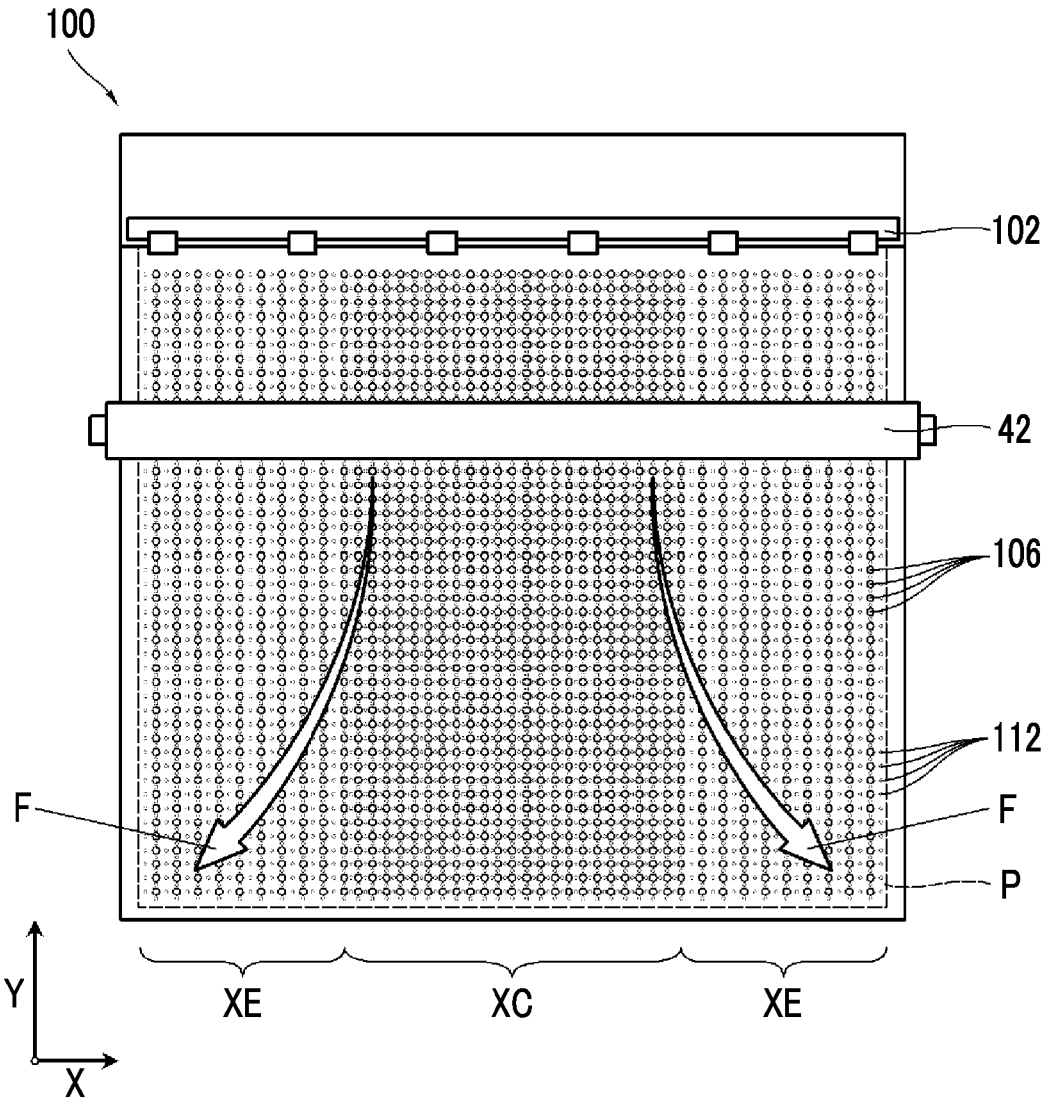
FIG. 9 is a view illustrating the action of recessed portions and protruding portions formed on the peripheral surface.

Since the amount of deformation of the sheet P that can be absorbed in both the end regions XE is larger than that in the middle region XC, the following forces act on the sheet P when the sheet P is pressed by the pressing roller 42. That is, when the sheet P is pressed by the pressing roller 42, forces F for pulling the sheet P to the outside (both ends of the image recording drum 100 in the width direction) from the middle as shown in FIG. 9 are generated. As a result, an effect of releasing the deformation of the sheet P to the outside is obtained. Accordingly, the sheet P can be made to come into close contact with (be held on) the peripheral surface 104 of the image recording drum 100 up to the rear end of the sheet P without the generation of wrinkles and floating. This will be further described.

Figure 10:
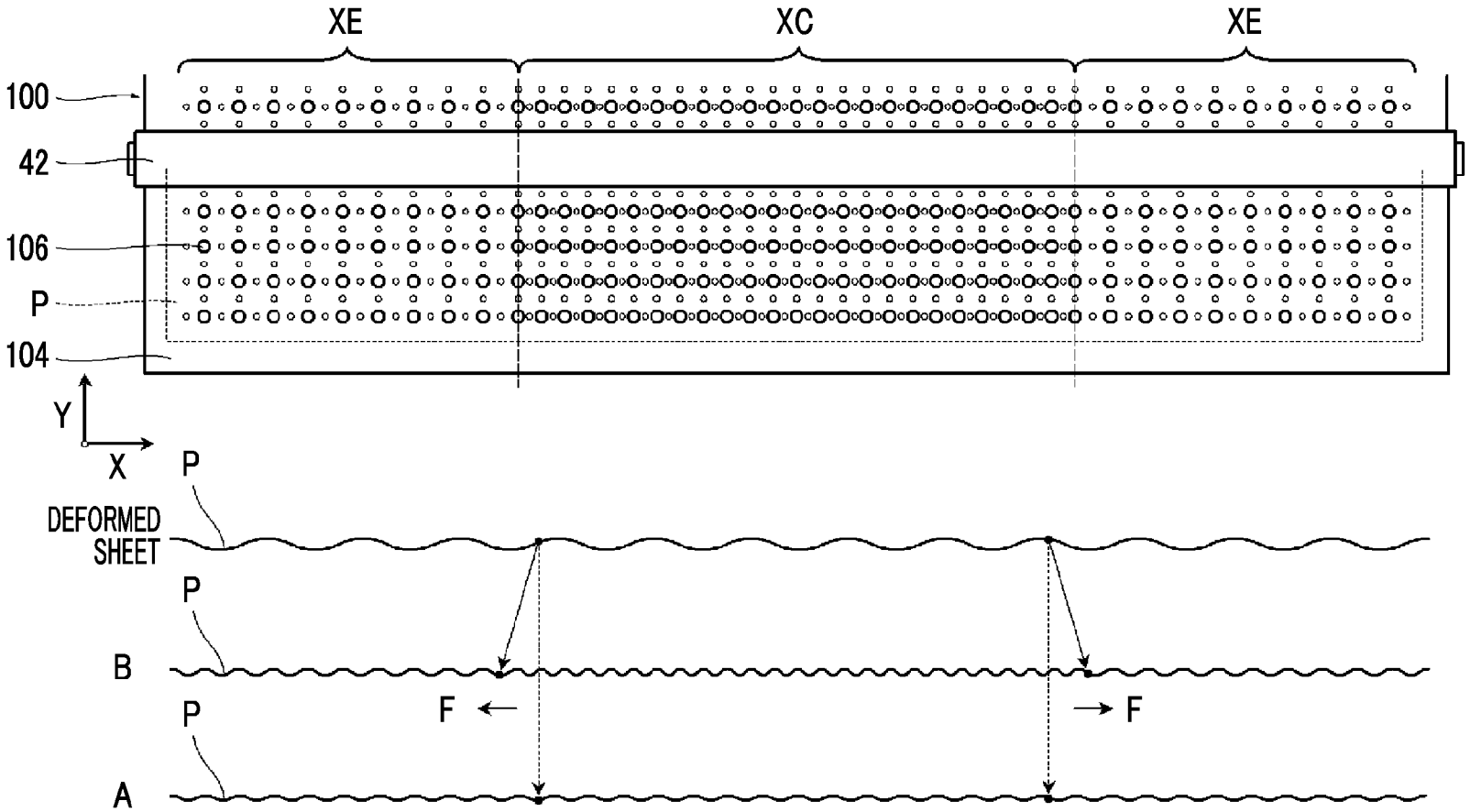
FIG. 10 is a view illustrating an effect of pulling a sheet.

FIG. 10 is a view illustrating an effect of pulling a sheet, and shows a comparison between a case in which an interval between the projections 106 is constant in the width direction (which is denoted in FIG. 10 by A) and a case in which an interval between the projections 106 is widened at both the end portions in the width direction (which is denoted in FIG. 10 by B).

The width of the recessed portion formed between adjacent projections 106 is constant in a case in which an interval between the projections 106 is constant in the width direction. Further, the volume of the recessed portions per unit area is also constant. In this case, the amount of deformation, which can be absorbed by each recessed portion, is constant even though the deformed sheet P is pressed by the pressing roller 42. For this reason, even though the sheet P is pressed by the pressing roller 42, forces for pulling the sheet P to the outside from the middle in the width direction (the X direction) are not generated. That is, the positions of bending are not changed substantially as shown by arrows that are shown in FIG. 10 by a dotted line.

In a case in which an interval between the projections 106 is widened at both the end portions in the width direction, the width of the recessed portion formed between adjacent projections 106 is widened at both the end portions in the width direction (the X direction). Further, the volume of the recessed portions per unit area is also increased at both the end portions in the width direction (the X direction). In this case, forces F for pulling the sheet P to the outside from the middle in the width direction (the X direction) are generated when the deformed sheet P is pressed by the pressing roller 42. That is, since the volume of the recessed portions per unit area at both the end portions is larger than that at the middle portion, the amount of deformation of the sheet P that can be absorbed at both the end portions is larger than that at the middle portion. As a result, forces F for pulling the sheet P to the outside from the middle in the width direction (the X direction) are generated. That is, bending is released to the outside as shown by arrows that are shown in FIG. 10 by a solid line. Accordingly, a sheet P can be made to come into close contact with (be held on) the peripheral surface 104 of the image recording drum 100 up to the rear end thereof without wrinkles. Further, the sheet P can be made to come into close contact with (be held on) the peripheral surface 104 of the image recording drum 100 without the generation of wrinkles and floating even in a case in which the sheet P is locally deformed.

Example

It is preferable that the specific sizes and the specific layout (setting rule) of the projections 106 disposed on the peripheral surface 104 of the image recording drum 100 are appropriately set in consideration of the thickness, the type, the size, and the like of a sheet P. That is, it is preferable that the sizes and the layout of the projections 106 are set so that a function to generate forces for pulling a sheet P to the outside is obtained in addition to a function to absorb the deformation of a sheet P.

The sizes and the layout of the projections 106 can be set as described below by way of example.

The diameter d of the projection 106 is set to the range of 0.5 mm to 3 mm (0.5 mm≤d≤3 mm).

When the width of the largest sheet P, which can be handled by the apparatus, (the width of the largest sheet P in the X direction) is denoted by WP, the width WC of the middle region XC in the X direction is set to the range of WP/4 to WP/2 (WP/4≤WC≤WP/2). That is, the middle region XC is set to the range of WP/4 to WP/2 at the middle portion of the image recording drum 100 in the width direction (the X direction), and regions positioned on both sides of the middle region XC are set as both the end regions XE.

When an interval between the projections 106 disposed in the middle region XC is denoted by x1, an interval between the projections 106 disposed in both the end regions XE is denoted by x2, and the diameter of the projection 106 is denoted by d, an interval between the projections 106 is set to a range in which conditions of "1.5*d≤x1≤3*d", "3*d≤x2≤6*d", and "x2≥2*x1" are satisfied (sign "*" means multiplication).

When a sheet P comes into contact with the bottom of each recessed portion (so called bottoming), each recessed portion cannot absorb the deformation of the sheet P any more. That is, the limit of the capacity for absorbing the deformation of a sheet P is determined depending on the depth of the recessed portion. Since the depth of the recessed portion is determined depending on the height of the projection 106, the height h of the projection 106 is set in consideration of the bottoming of a sheet P. For example, the height h of the projection 106 is set to the range of 20 μm to 200 μm (20 μm≤h≤200 μm).

Modification Examples of First Embodiment

Figure 11A:
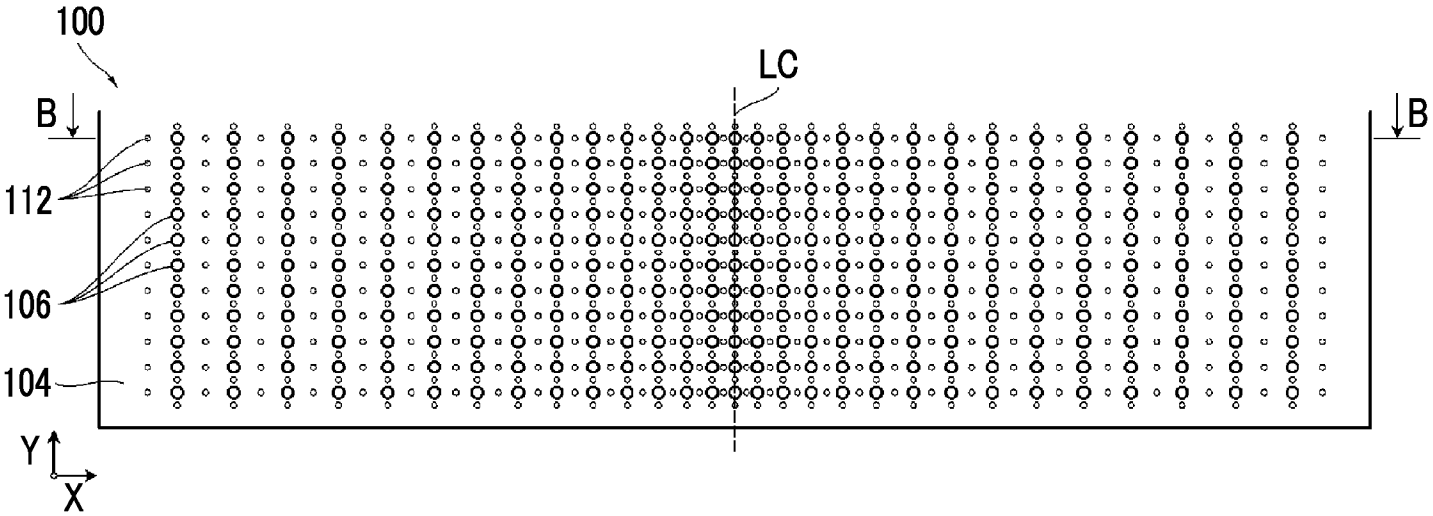
FIGS. 11A and 11B are views showing Modification example (1) of the first embodiment.
Figure 11B:
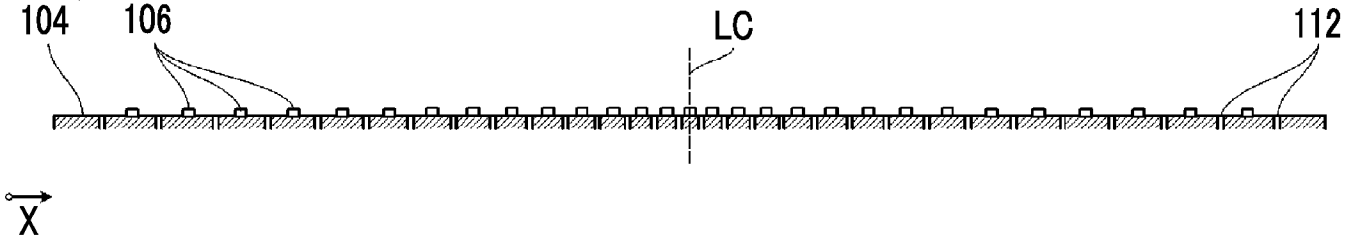

FIGS. 11A and 11B are views showing Modification example (1) of the first embodiment. FIG. 11A is a plan view of a part of the peripheral surface 104 of the image recording drum 100, and FIG. 11B is a cross-sectional view taken along line B-B of FIG. 11A. Further, in FIGS. 11A and 11B, a broken line LC is the centerline of the peripheral surface 104 of the image recording drum 100 in the width direction (the X direction).

In an example shown in FIGS. 11A and 11B, projections 106 are disposed so that an interval between adjacent projections 106 in the width direction (the X direction) is gradually widened, that is, gradually increased toward both ends from the middle in the width direction (the X direction).

Even in a case in which the projections are disposed in this way, forces for pulling a sheet P to the outside from the middle can be generated when the sheet P is pressed by the pressing roller 42. Accordingly, the sheet P can be made to come into close contact with (be held on) the peripheral surface 104 of the image recording drum 100 without the generation of wrinkles and floating.

That is, projections 106 are disposed so that an interval between adjacent projections 106 in the width direction (the X direction) is gradually increased toward both ends from the middle. Accordingly, the width of the recessed portion formed between adjacent projections 106 is gradually increased toward both ends from the middle in the width direction (the X direction). As a result, since the cross-sectional area of the recessed portion at the position where projections 106 are provided is also gradually increased toward both ends from the middle in the width direction (the X direction), the volume of the recessed portion is also gradually increased toward both ends from the middle in the width direction (the X direction). That is, the volume of the recessed portions per unit area is gradually increased toward both ends from the middle in the width direction (the X direction). As a result, since capacity for absorbing the deformation of a sheet P is increased at both end portions in the width direction, forces for pulling the sheet P to the outside from the middle can be generated when the sheet P is pressed by the pressing roller 42. Accordingly, the sheet P can be made to come into close contact with (be held on) the peripheral surface 104 of the image recording drum 100 without the generation of wrinkles and floating.

Figure 12A:
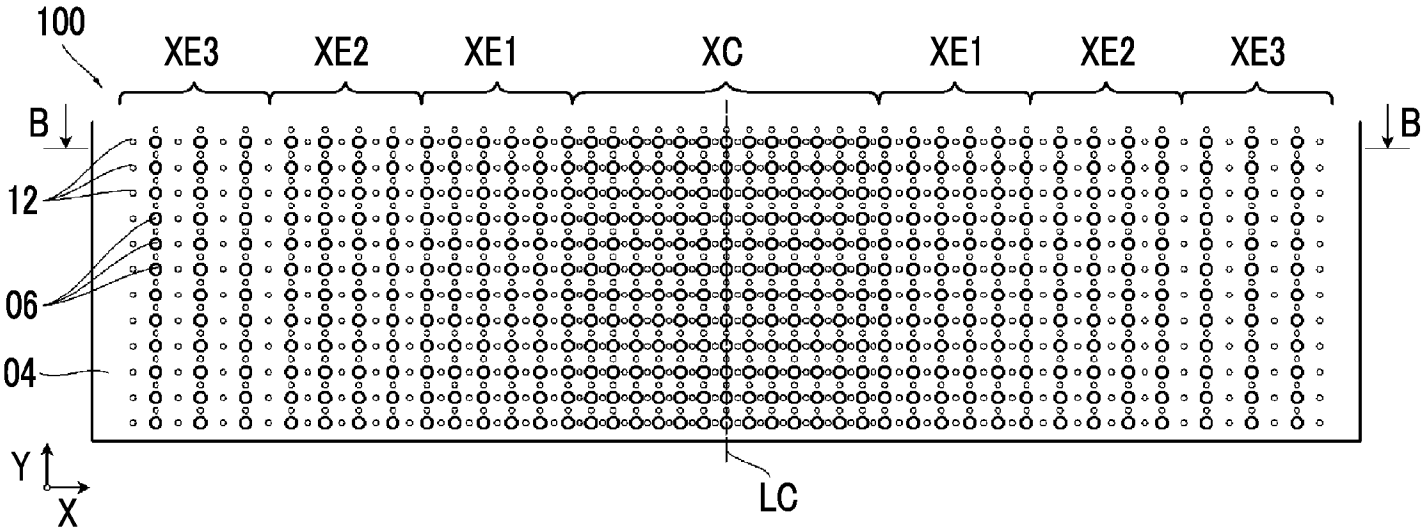
FIGS. 12A and 12B are views showing Modification example (2) of the first embodiment.
Figure 12B:
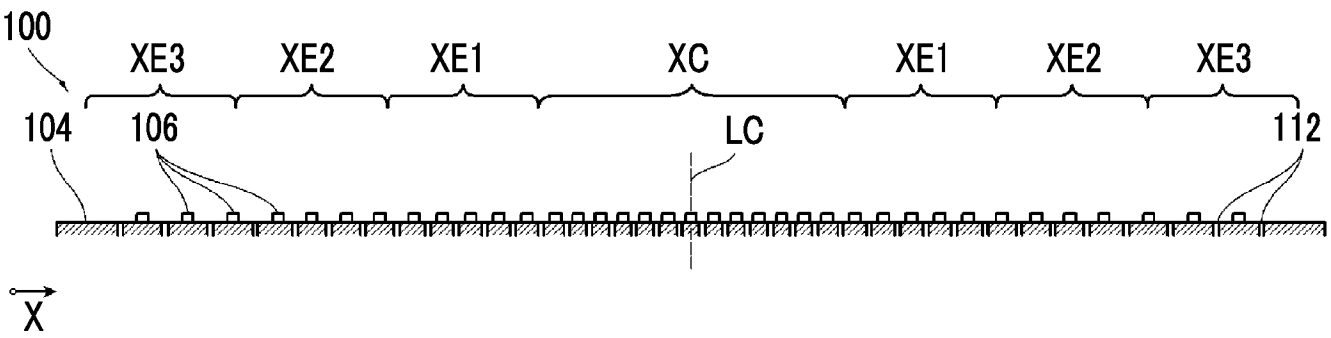

FIGS. 12A and 12B are views showing Modification example (2) of the first embodiment. FIG. 12A is a plan view of a part of the peripheral surface 104 of the image recording drum 100, and FIG. 12B is a cross-sectional view taken along line B-B of FIG. 12A. Further, in FIGS. 12A and 12B, a broken line LC is the centerline of the peripheral surface 104 of the image recording drum 100 in the width direction (the X direction).

In an example shown in FIGS. 12A and 12B, projections 106 are disposed so that an interval between adjacent projections 106 in the width direction (the X direction) is gradually widened in stages toward both ends from the middle in the width direction (the X direction). In more detail, as shown in FIGS. 12A and 12B, the peripheral surface 104 of the image recording drum 100 is divided into four kinds of regions, that is, a middle region XC, first outer regions XE1 that are positioned outside the middle region XC, second outer regions XE2 that are positioned outside the first outer regions XE1, and third outer regions XE3 that are positioned outside the second outer regions XE2; and an interval between projections 106 is set to be widened in stages toward the outer regions. That is, an interval in each region is constant; but an interval between the projections 106 is set so that an interval between the projections 106 disposed in the first outer regions XE1 is wider than an interval between the projections 106 disposed in the middle region XC and an interval between the projections 106 is set so that an interval between the projections 106 disposed in the second outer regions XE2 is wider than an interval between the projections 106 disposed in the first outer regions XE1. Further, an interval between the projections 106 is set so that an interval between the projections 106 disposed in the third outer regions XE3 is wider than an interval between the projections 106 disposed in the second outer regions XE2.

Even in a case in which the projections are disposed in this way, forces for pulling a sheet P to the outside from the middle can be generated when the sheet P is pressed by the pressing roller 42. Accordingly, the sheet P can be made to come into close contact with (be held on) the peripheral surface 104 of the image recording drum 100 without the generation of wrinkles and floating.

That is, since projections 106 are disposed so that an interval between adjacent projections 106 in the width direction (the X direction) is increased in stages toward both ends from the middle, the width of the recessed portion formed between adjacent projections 106 is increased in stages toward both ends from the middle in the width direction (the X direction). As a result, since the cross-sectional area of the recessed portion at the position where projections 106 are provided is also increased in stages toward both ends from the middle in the width direction (the X direction), the volume of the recessed portion is also increased in stages toward both ends from the middle in the width direction (the X direction). That is, the volume of the recessed portions per unit area is gradually increased toward both ends from the middle in the width direction (the X direction). As a result, since capacity for absorbing the deformation of a sheet P is increased at both end portions in the width direction, forces for pulling the sheet P to the outside from the middle can be generated when the sheet P is pressed by the pressing roller 42. Accordingly, the sheet P can be made to come into close contact with (be held on) the peripheral surface 104 of the image recording drum 100 without the generation of wrinkles and floating.

Second Embodiment

[Structure]

In the first embodiment, a desired uneven shape is formed on the peripheral surface 104 of the image recording drum 100 by a change in the interval between the projections that form the protruding portions.

In this embodiment, a desired uneven shape is realized on a peripheral surface 104 of an image recording drum 100 by a change in the area of the surface of each protruding portion that comes into contact with a sheet P. Here, the surface of each protruding portion, which comes into contact with a sheet P, is the end surface of the protruding portion. In this embodiment, each protruding portion is formed of a columnar projection 106. Accordingly, in this embodiment, a desired uneven shape is realized on the peripheral surface 104 of the image recording drum 100 by a change in the diameter of the projection 106.

Figure 13:
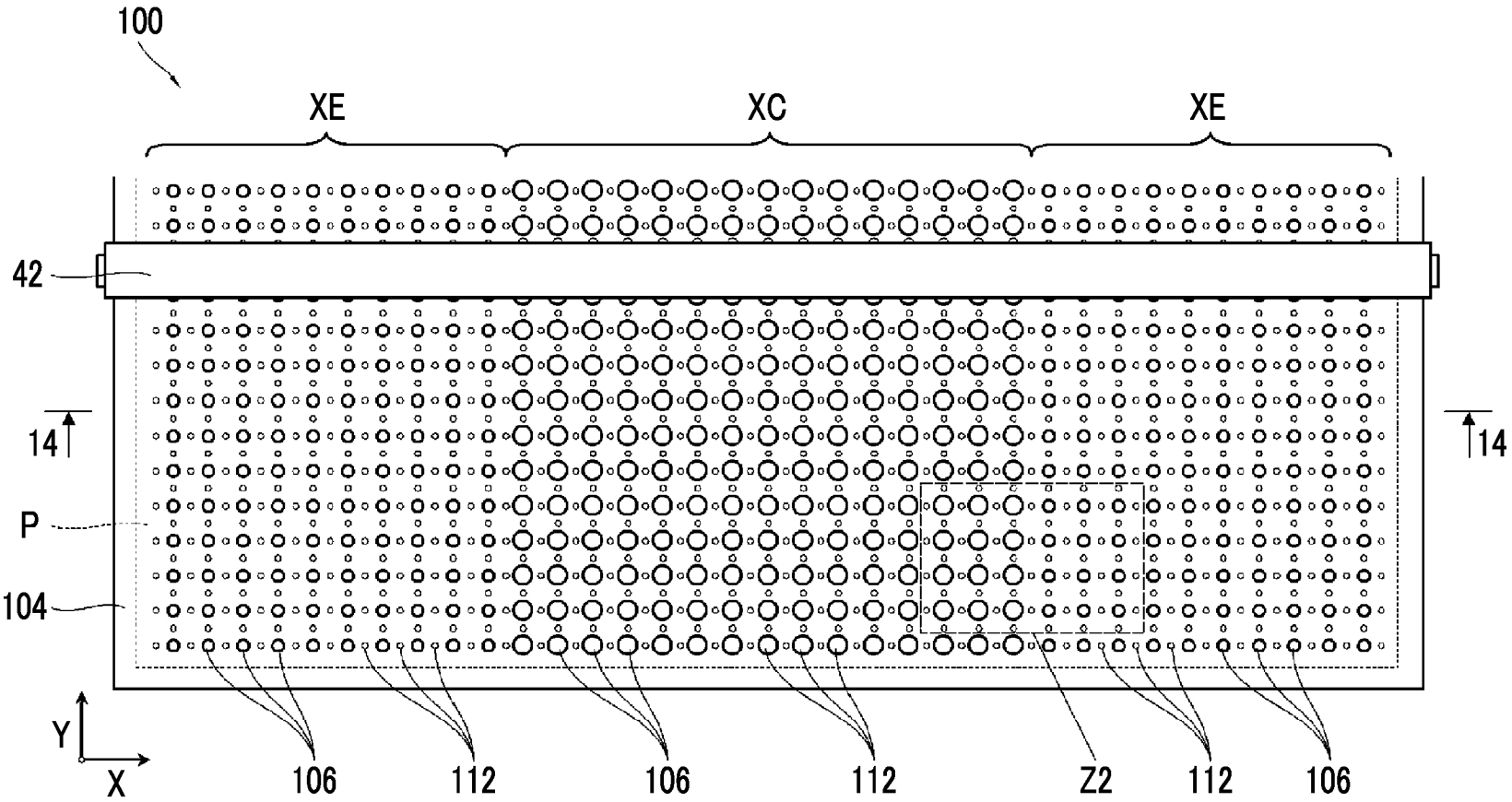
FIG. 13 is a development view showing the structure of main portions of the peripheral surface of an image recording drum.
Figure 14:
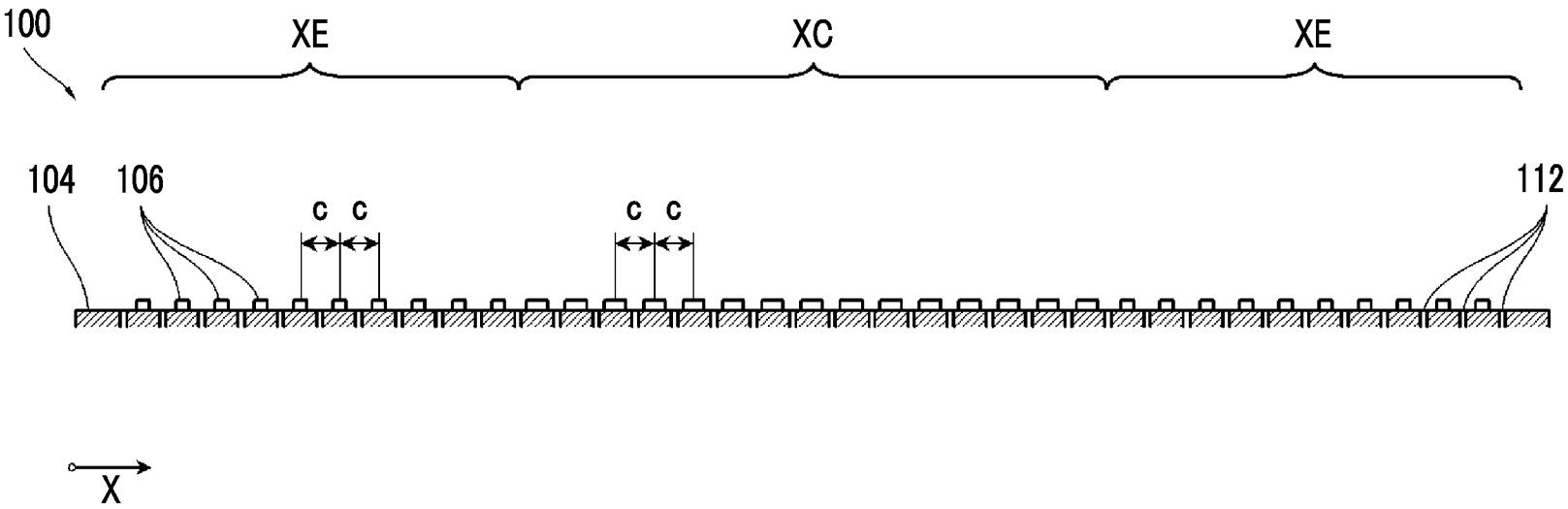
FIG. 14 is a cross-sectional view taken along line 14-14 of FIG. 13.
Figure 15:
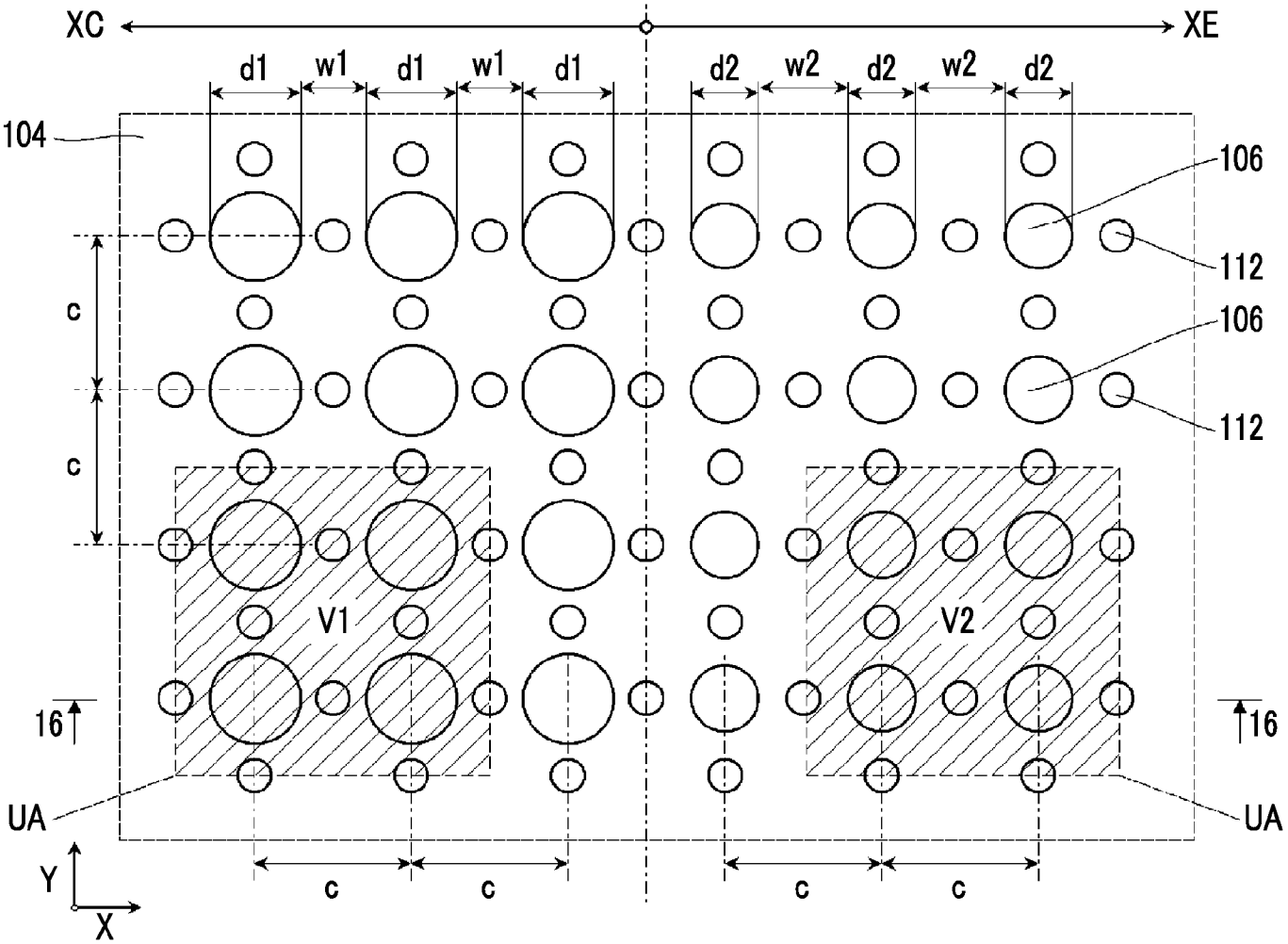
FIG. 15 is an enlarged view of a part (a region Z2 surrounded by a broken line) of FIG. 13.
Figure 16:
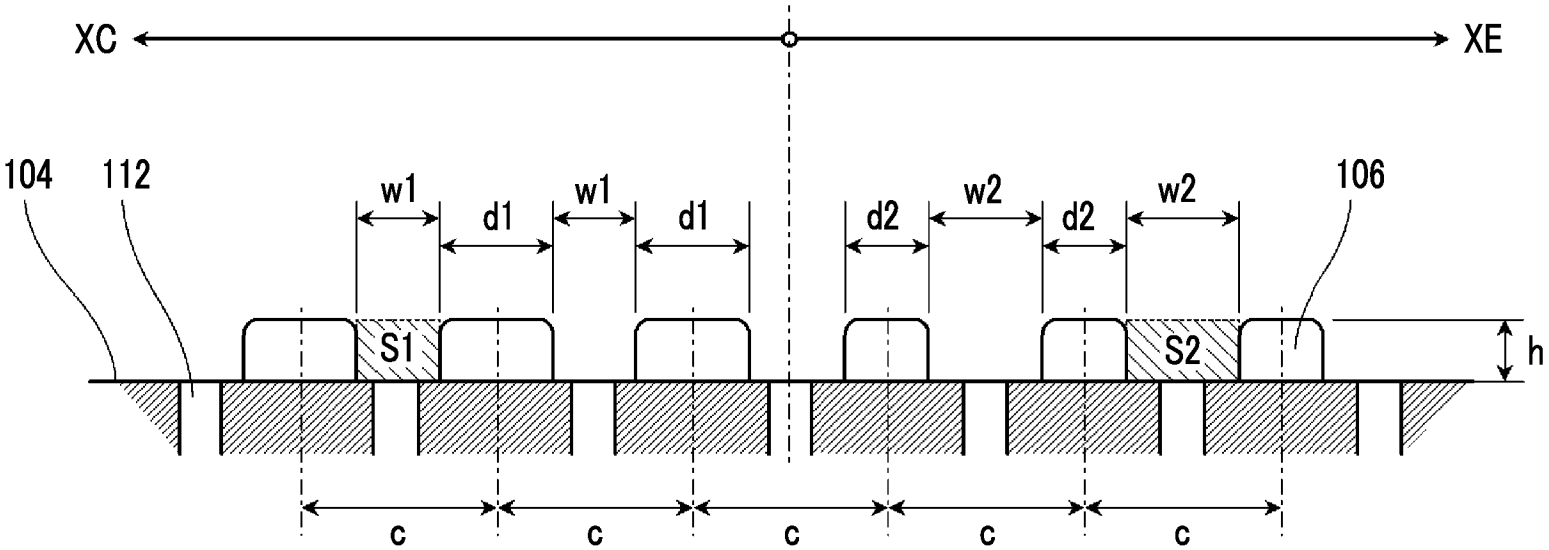
FIG. 16 is a cross-sectional view taken along line 16-16 of FIG. 15.

FIG. 13 is a development view showing the structure of main portions of the peripheral surface of the image recording drum. FIG. 14 is a cross-sectional view taken along line 14-14 of FIG. 13. FIG. 15 is an enlarged view of a part (a region Z2 surrounded by a broken line) of FIG. 13. FIG. 16 is a cross-sectional view taken along line 16-16 of FIG. 15.

As shown in FIGS. 13 to 16, the respective projections 106 have a columnar shape and are disposed at regular intervals c in the conveying direction (the Y direction) and the width direction (the X direction). However, the respective projections 106 are set to different diameters at a middle portion and both end portions in the width direction (the X direction). That is, large-diameter projections 106 are disposed in a middle region XC and small-diameter projections 106 are disposed in both end regions XE. In more detail, as shown in FIGS. 15 and 16, projections 106 having a diameter d1 are disposed in the middle region XC and projections 106 having a diameter d2, which is smaller than the diameter d1 (d2<d1), are disposed in both the end regions XE. The projections 106 have the same height h.

Since the diameters of the projections 106 to be disposed are changed in this way, the size of a recessed portion formed between adjacent projections 106 is changed. In this embodiment, each of the recessed portions formed in both the end regions XE is larger than each of the recessed portions formed in the middle region XC since the diameter of each of the projections 106 disposed in the both the end regions XE is smaller than the diameter of each of the projections 106 disposed in the middle region XC. In this case, when a cross-section is taken in the width direction (the X direction), the cross-sectional area S2 of each of the recessed portions formed in both the end regions XE is larger than the cross-sectional area S1 of each of the recessed portions formed in the middle region XC (S1<S2). Further, when a relationship of the volume of the recessed portion formed between adjacent projections 106 is taken, the volume of each of the recessed portions formed in the both end regions XE is larger than the volume of each of the recessed portions formed in the middle region XC. As a result, in regard to the volume of the recessed portions per unit area UA, the volume V2 of the recessed portions per unit area UA in both the end regions XE is larger than the volume V1 of the recessed portions per unit area UA in the middle region XC as shown in FIG. 15. In other words, the sum of the volumes of the recessed portions formed in both the end regions XE is larger than the sum of the volumes of the recessed portions formed in the middle region XC.

Suction holes 112 are disposed between the projections in the conveying direction (the Y direction) and the width direction (the X direction). That is, each of the suction holes 112 is disposed in the recessed portion. More specifically, each suction hole 112 is disposed at an intermediate position between the projections 106 arranged in the conveying direction (the Y direction), and each suction hole 112 is disposed at an intermediate position between the projections 106 arranged in the width direction (the X direction).

[Action]

As in the image recording drum 100 of the first embodiment, the image recording drum 100 of this embodiment also includes recessed portions and protruding portions on the peripheral surface 104 thereof and the recessed portions and the protruding portions have a shape in which the volume of the recessed portions, each which is formed between adjacent projections (protruding portions) 106, per unit area at both the end portions in the width direction (the X direction) that is a direction orthogonal to the conveying direction of the sheet P (the Y direction) is larger than the volume of the recessed portions per unit area at the middle portion in the width direction (the X direction). Accordingly, as in the image recording drum 100 of the first embodiment, the deformation of a sheet P can be absorbed by the recessed portions even in a case in which the sheet P is deformed. Therefore, the generation of wrinkles and floating can be prevented. Further, the generation of wrinkles and floating can be prevented even in a case in which the sheet is locally deformed.

Figure 17B:
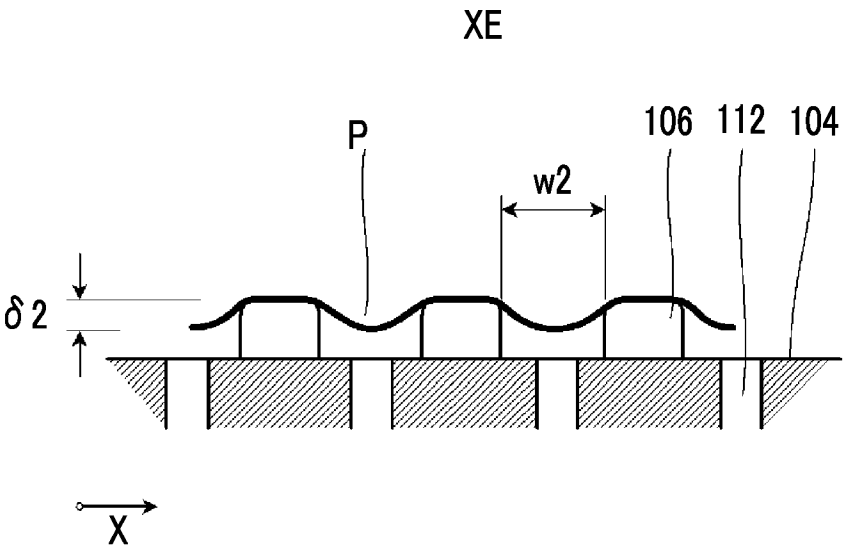
FIGS. 17A and 17B are views showing a state in which the deformation of a sheet is absorbed by recessed portions formed on the peripheral surface.
Figure 17A:
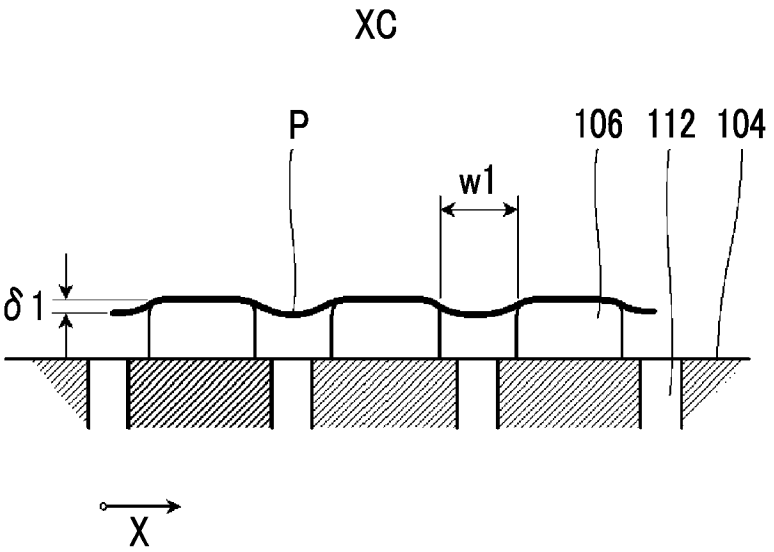

FIGS. 17A and 17B are views showing a state in which the deformation of a sheet is absorbed by the recessed portions. FIG. 17A shows a state in which the deformation of the sheet P is absorbed in the middle region XC, and FIG. 17B shows a state in which the deformation of the sheet P is absorbed in both the end regions XE.

When the length of the bent arc (the length of the curved arc) of the sheet P, which is obtained when the sheet P is pressed by the pressing roller 42, in both the end regions XE is compared with that in the middle region XC, the length of the bent arc of the sheet P in both the end regions XE is larger than that in the middle region XC as shown in FIGS. 17A and 17B. As a result, the amount δ2 of bending of the sheet P in both the end regions XE is larger than the amount δ1 of bending of the sheet P in the middle region XC. Accordingly, even in the case of the image recording drum 100 of this embodiment, the amount of deformation of the sheet P that can be absorbed in both the end regions XE is larger than that in the middle region XC.

Since the amount of deformation of the sheet P that can be absorbed in both the end regions XE is larger than that in the middle region XC, forces F for pulling the sheet P to the outside from the middle are generated when the sheet P is pressed by the pressing roller 42. As a result, an effect of releasing the deformation of the sheet P to the outside is obtained (see FIG. 9). Accordingly, the sheet P can be made to come into close contact with (be held on) the peripheral surface 104 of the image recording drum 100 up to the rear end of the sheet P without the generation of wrinkles and floating.

Example

It is preferable that the specific sizes and the specific layout of the projections 106 disposed on the peripheral surface 104 of the image recording drum 100 are appropriately set in consideration of the thickness, the type, the size, and the like of a sheet P. That is, it is preferable that the sizes and the layout of the projections 106 are set so that a function to generate forces for pulling a sheet P to the outside is obtained in addition to a function to absorb the deformation of a sheet P.

The sizes and the layout of the projections 106 can be set as described below by way of example.

The diameters d1 and d2 of the projections 106 are set to the range of 0.5 mm to 3 mm (0.5 mm≤d≤3 mm). Further, the height h of the projection 106 is set to the range of 20 μm to 200 μm (20 μm≤h≤200 μm).

Furthermore, when the diameter of each of the projections 106 disposed in the middle region XC is denoted by d1 and the diameter of each of the projections 106 disposed in both the end regions XE is denoted by d2, the diameter of the projection 106 set in each region is set to a range in which conditions of "1 mm≤d1≤3 mm", "0.5 mm≤d2≤1.5 mm", and "d1≥2*d2" are satisfied (sign "*" means multiplication).

Moreover, when the diameter of the projection 106 disposed in the middle region XC is denoted by d1, the interval c between the projections 106 is set to the range of "6*d1≥c≥d1" (sign "*" means multiplication).

When the width of the largest sheet P, which can be printed by the apparatus, (the width of the largest sheet P in the X direction) is denoted by WP, the width WC of the middle region XC in the X direction is set to the range of WP/4 to WP/2 (WP/4≤WC≤WP/2). That is, the middle region XC is set to the range of WP/4 to WP/2 at the middle portion of the image recording drum 100 in the width direction (the X direction), and regions positioned on both sides of the middle region XC are set as both the end regions XE.

The height h of the projection 106 is set in consideration of the bottoming of a sheet P. For example, the height h of the projection 106 is set to the range of 20 μm to 200 μm (20 μm≤h≤200 μm).

[Modification examples of second embodiment]

Figure 18:
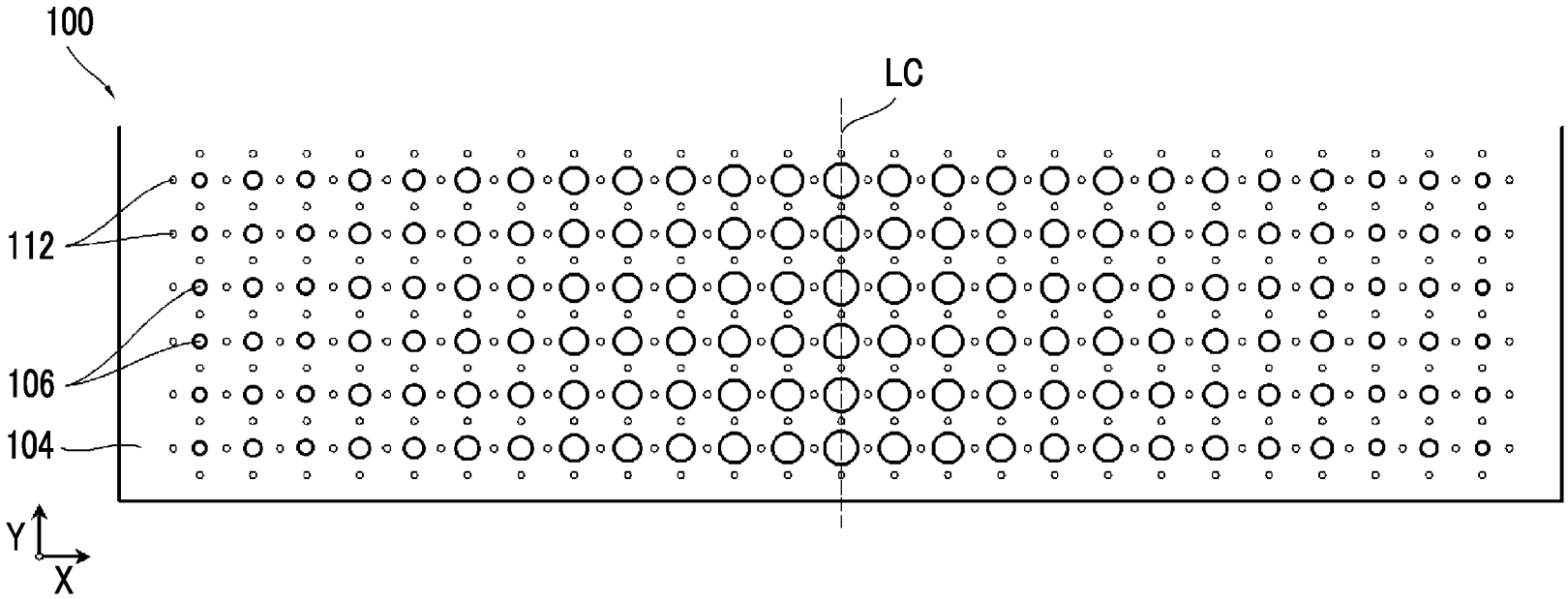
FIG. 18 is a view showing Modification example (1) of a second embodiment.

FIG. 18 is a view showing Modification example (1) of the second embodiment, and is a plan view of a part of the peripheral surface 104 of the image recording drum 100. In FIG. 18, a broken line LC is the centerline of the peripheral surface 104 of the image recording drum 100 in the width direction (the X direction).

In an example shown in FIG. 18, in regard to the width direction (the X direction), the diameter of a projection 106 is set to be gradually reduced toward both ends from the middle in the width direction (the X direction).

Since the width of a recessed portion formed between adjacent projections (protruding portions) 106 disposed at both end portions in the width direction (the X direction) is larger than that at the middle portion even in this case, the volume of the recessed portions per unit area at both the end portions in the width direction (the X direction) is larger than that at the middle portion.

Figure 19:
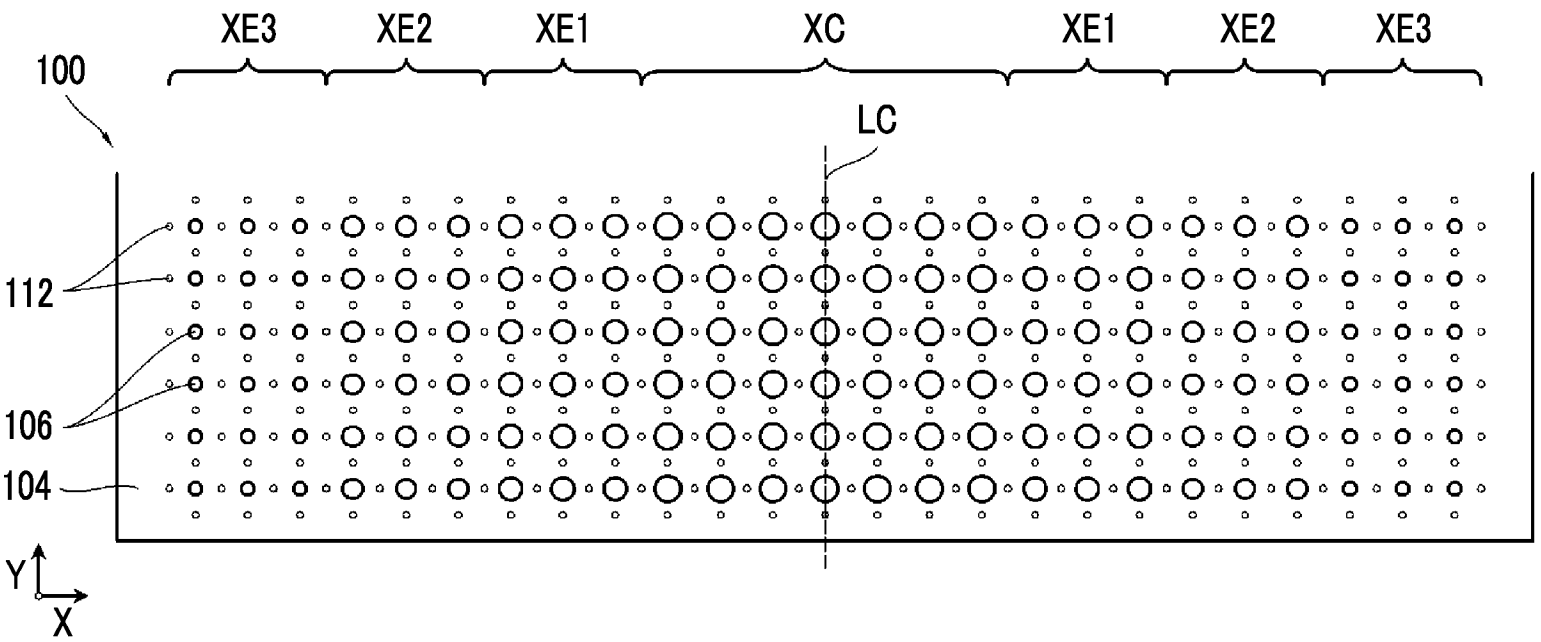
FIG. 19 is a view showing Modification example (2) of the second embodiment.

FIG. 19 is a view showing Modification example (2) of the second embodiment, and is a plan view of a part of the peripheral surface 104 of the image recording drum 100. In FIG. 19, a broken line LC is the centerline of the peripheral surface 104 of the image recording drum 100 in the width direction (the X direction).

In an example shown in FIG. 19, in regard to the width direction (the X direction), the diameter of a projection 106 is set to be reduced in stages toward both ends from the middle in the width direction (the X direction).

Since the width of a recessed portion formed between adjacent projections (protruding portions) 106 disposed at both end portions in the width direction (the X direction) is larger than that at the middle portion even in this case, the volume of the recessed portions per unit area at both the end portions in the width direction (the X direction) is larger than that at the middle portion.

In an example shown in FIG. 19, the peripheral surface 104 of the image recording drum 100 is divided into four kinds of regions, that is, a middle region XC, first outer regions XE1 that are positioned outside the middle region XC, second outer regions XE2 that are positioned outside the first outer regions XE1, and third outer regions XE3 that are positioned outside the second outer regions XE2; and the diameter of the projection 106 is set to be reduced in stages toward the outer regions. That is, the projections disposed in each region have the same diameter; but the diameter of each of the projections 106 disposed in the first outer regions XE1 is set to be smaller than the diameter of each of the projections 106 disposed in the middle region XC and the diameter of each of the projections 106 disposed in the second outer regions XE2 is set to be smaller than the diameter of each of the projections 106 disposed in the first outer regions XE1. Further, the diameter of each of the projections 106 disposed in the third outer regions XE3 is set to be smaller than the diameter of each of the projections 106 disposed in the second outer regions XE2.

Third Embodiment

[Structure]

In the second embodiment, a desired uneven shape is realized on the peripheral surface 104 of the image recording drum 100 by a change in the diameter of each of the projections that form the protruding portions. Particularly, in the second embodiment, a desired uneven shape is realized by a change in the diameter of each of the projections that form the protruding portions. In this embodiment, a desired uneven shape is realized by a change in the height of each of the projections that form the protruding portions.

Figure 20:
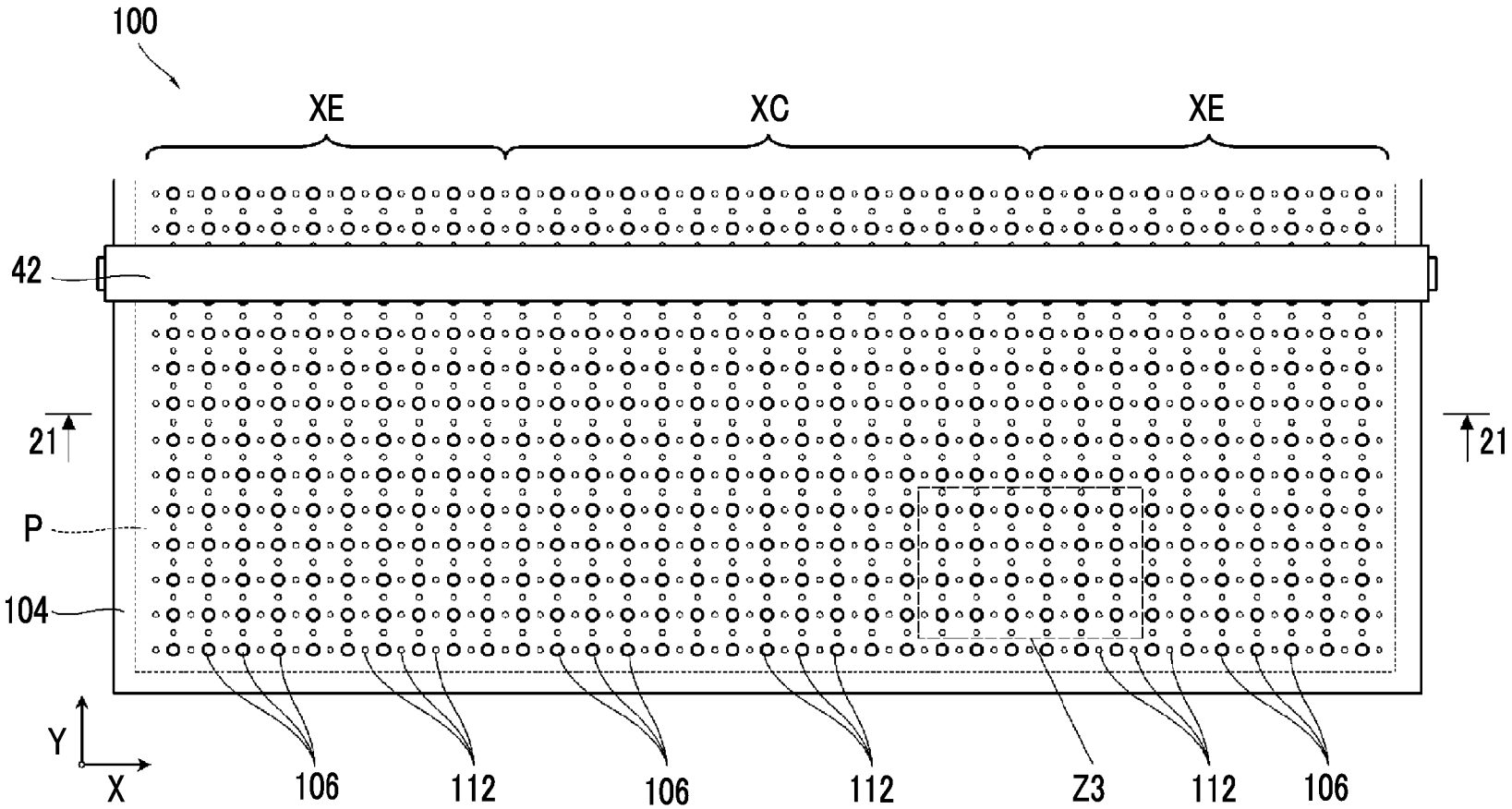
FIG. 20 is a development view showing the structure of main portions of the peripheral surface of an image recording drum.
Figure 21:
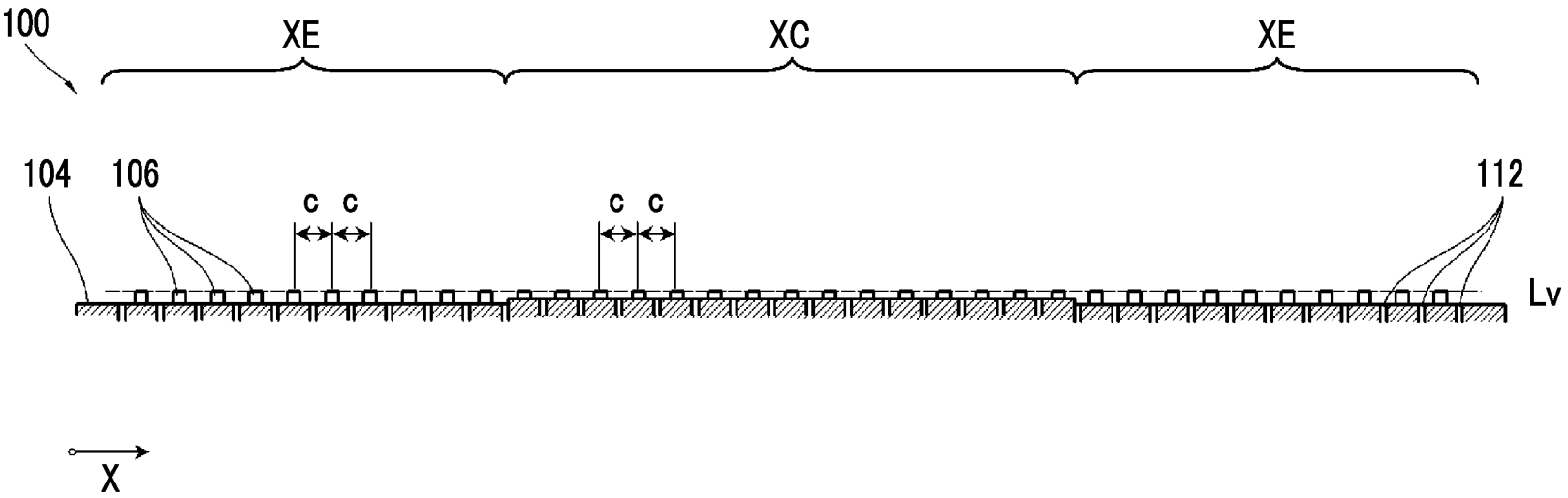
FIG. 21 is a cross-sectional view taken along line 21-21 of FIG. 20.
Figure 22:
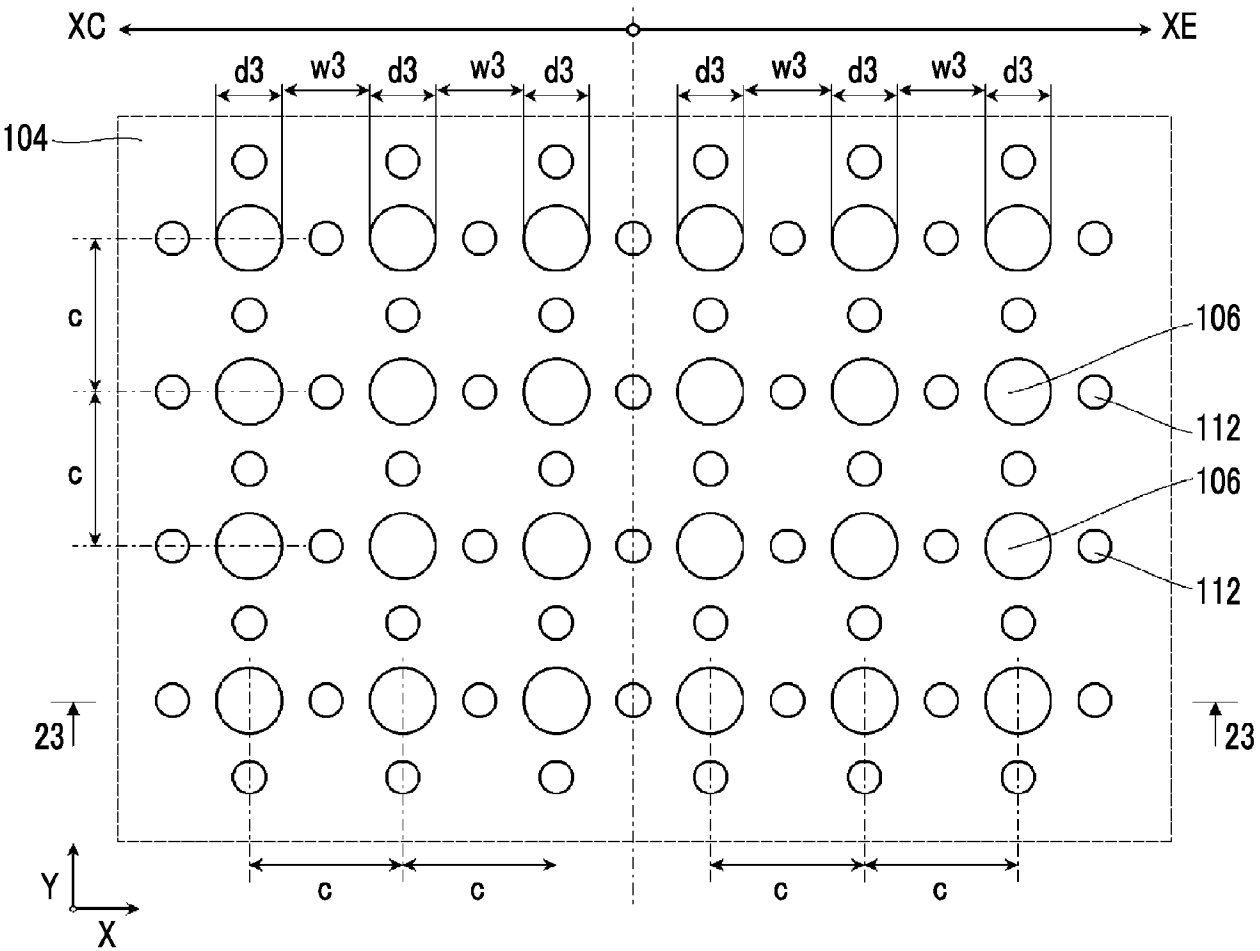
FIG. 22 is an enlarged view of a part (a region Z3 surrounded by a broken line) of FIG. 20.
Figure 23:
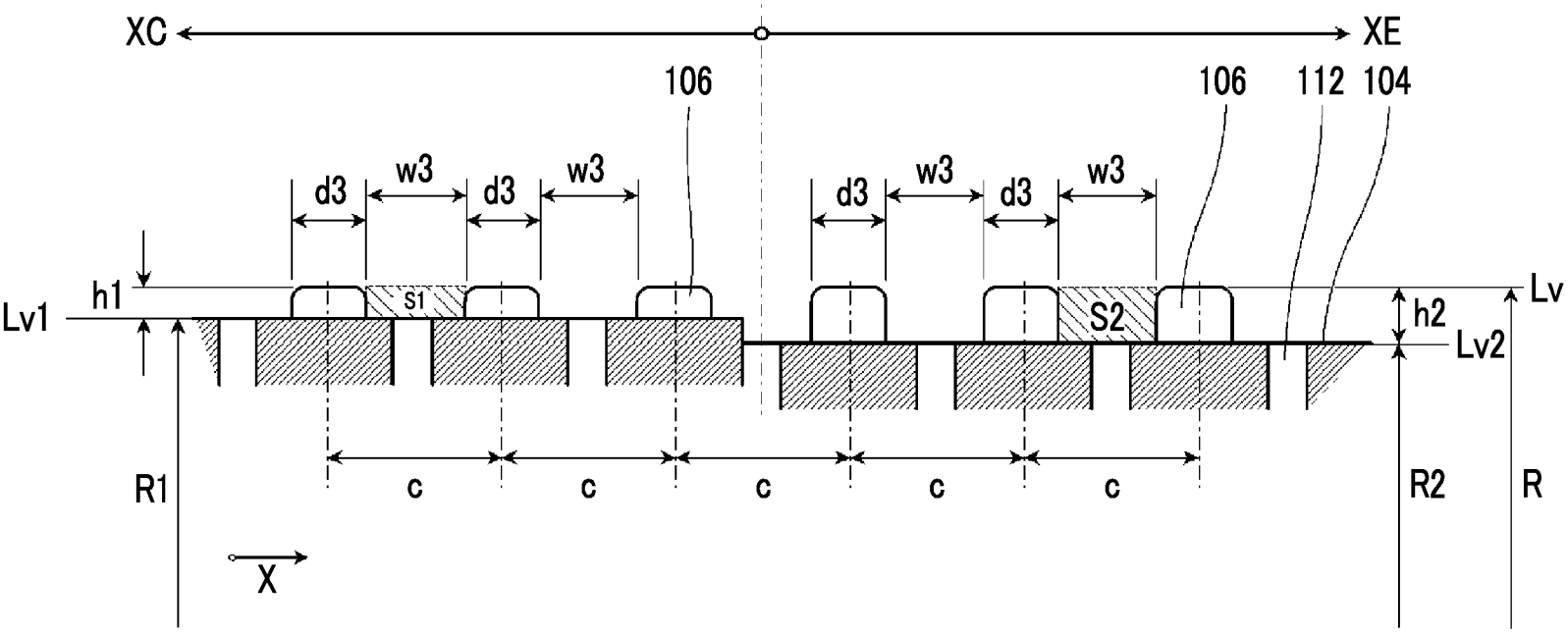
FIG. 23 is a cross-sectional view taken along line 23-23 of FIG. 22.

FIG. 20 is a development view showing the structure of main portions of the peripheral surface of an image recording drum. FIG. 21 is a cross-sectional view taken along line 21-21 of FIG. 20. FIG. 22 is an enlarged view of a part (a region Z3 surrounded by a broken line) of FIG. 20. FIG. 23 is a cross-sectional view taken along line 23-23 of FIG. 22.

As shown in FIGS. 20 to 23, the respective projections 106 have a columnar shape and are disposed at regular intervals c in the conveying direction (the Y direction) and the width direction (the X direction). However, the respective projections 106 are set to different heights at a middle portion and both end portions in the width direction (the X direction). That is, small-height projections 106 are disposed in a middle region XC and large-height projections 106 are disposed in both end regions XE. In more detail, as shown in FIGS. 22 and 23, projections 106 having a height h1 are disposed in the middle region XC and projections 106 having a height h2, which is larger than the height h1 (h1<h2), are disposed in both the end regions XE.

The respective projections 106 are installed so that height positions Lv of ends of the projections 106 are aligned with each other. That is, all the projections 106 are disposed so that the ends of the projection 106 are positioned on the same circumference having the center on the axis of an image recording drum 100. For this purpose, the image recording drum 100 is formed so that the height Lv2 of the peripheral surface 104 of the image recording drum 100 in both the end regions XE is smaller than the height Lv1 of the peripheral surface thereof in the middle region XC. That is, the image recording drum 100 is formed so that the height of the peripheral surface 104 is lowed in both the end regions XE by a difference (h2−h1) between the height of each of the projections 106 disposed in the middle region XC and the height of each of the projections 106 disposed in the both the end regions XE. Specifically, the radius of the peripheral surface 104 is R1 in the middle region XC and the radius of the peripheral surface 104 is R2 in both the end regions XE. The radius R1 in the middle region XC is larger than the radius R2 in both the end regions XE by the difference (h2−h1) in the height of the projection 106. Accordingly, the height positions Lv of the ends of the projections 106, which are disposed in all the regions, are aligned with each other. Therefore, when a sheet P is made to come into close contact with the peripheral surface 104 of the image recording drum 100, the height of the sheet P can be maintained constant over the entire region of the sheet P. That is, a slow distance can be maintained constant.

The respective projections 106 have the same diameter d3.

Since the heights of the projections 106 to be disposed are changed in this way, the size of a recessed portion formed between adjacent projections 106 is changed. In this embodiment, each of the recessed portions formed in both the end regions XE is larger than each of the recessed portions formed in the middle region XC since the height of each of the projections 106 disposed in the both the end regions XE is larger than the height of each of the projections 106 disposed in the middle region XC. In this case, when a cross-section is taken in the width direction (the X direction), the cross-sectional area S2 of each of the recessed portions formed in both the end regions XE is larger than the cross-sectional area S1 of each of the recessed portions formed in the middle region XC (S1<S2) in regard to the cross-sectional area of the recessed portion formed between adjacent projections 106. Further, when a relationship of the volume of the recessed portion formed between adjacent projections 106 is taken, the volume of each of the recessed portions formed in the both end regions XE is larger than the volume of each of the recessed portions formed in the middle region XC in the width direction (the X direction). As a result, in regard to the volume of the recessed portions per unit area UA, the volume V2 of the recessed portions per unit area UA in both the end regions XE is larger than the volume V1 of the recessed portions per unit area UA in the middle region XC. In other words, the sum of the volumes of the recessed portions formed in both the end regions XE is larger than the sum of the volumes of the recessed portions formed in the middle region XC.

Suction holes 112 are disposed between the projections in the conveying direction (the Y direction) and the width direction (the X direction). That is, each of the suction holes 112 is disposed in the recessed portion. More specifically, each suction hole 112 is disposed at an intermediate position between the projections 106 arranged in the conveying direction (the Y direction), and each suction hole 112 is disposed at an intermediate position between the projections 106 arranged in the width direction (the X direction).

[Action]

As in the image recording drum 100 of the first embodiment, the image recording drum 100 of this embodiment also includes recessed portions and protruding portions on the peripheral surface 104 thereof and the recessed portions and the protruding portions have a shape in which the volume of the recessed portions, each of which is formed between adjacent projections (protruding portions) 106, per unit area at both the end portions in the width direction (the X direction) that is a direction orthogonal to the conveying direction of the sheet P (the Y direction) is larger than the volume of the recessed portions per unit area at the middle portion in the width direction (the X direction). Accordingly, as in the image recording drum 100 of the first embodiment, the deformation of a sheet P can be absorbed by the recessed portions even in a case in which the sheet P is deformed. Therefore, the generation of wrinkles and floating can be prevented. Further, the generation of wrinkles and floating can be prevented even in a case in which the sheet is locally deformed.

The image recording drum 100 of this embodiment is slightly different from the image recording drums of the first and second embodiments in terms of a mechanism that generates pulling forces in the width direction (the X direction).

Figure 24A:
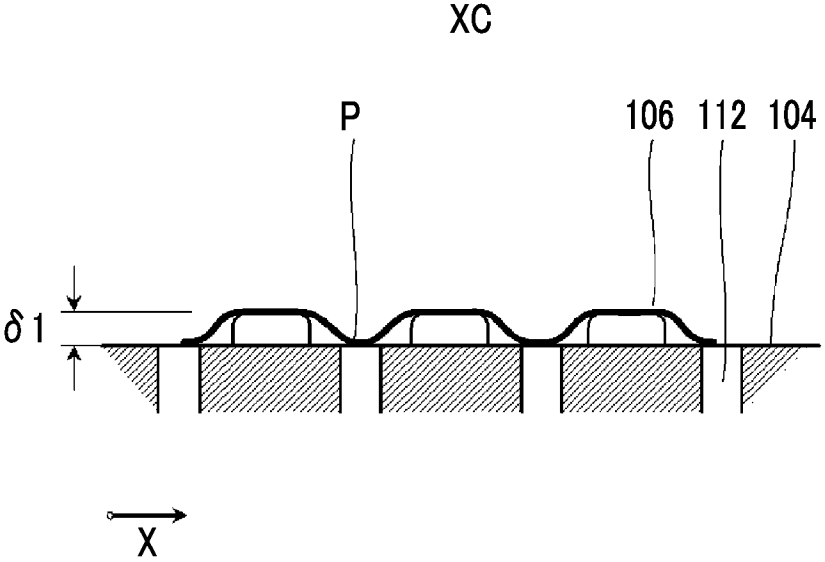
FIGS. 24A and 24B are views showing a state in which the deformation of a sheet is absorbed by recessed portions formed on the peripheral surface.
Figure 24B:
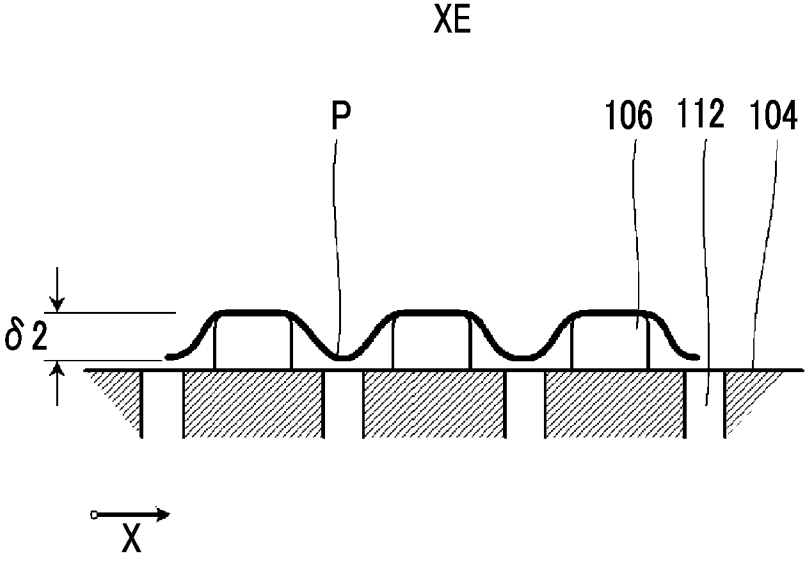

FIGS. 24A and 24B are views showing a state in which the deformation of a sheet is absorbed by the recessed portions. FIG. 24A shows a state in which the deformation of the sheet P is absorbed in the middle region XC, and FIG. 24B shows a state in which the deformation of the sheet P is absorbed in both the end regions XE.

Since the depth of each recessed portion is set to be small in the middle region XC as shown in FIG. 24A, the sheet P comes into contact with the bottom of each recessed portion. On the other hand, since the depth of each recessed portion is set to be large in both the end regions XE as shown in FIG. 24B, there is a margin for capacity for absorbing the deformation of the sheet P. Accordingly, the amount of deformation of the sheet P that can be absorbed in both the end regions XE is larger than that in the middle region XC. As a result, since forces F for pulling the sheet P to the outside (toward both ends in the width direction (the X direction)) from the middle are generated when the sheet P is made to come into close contact with the peripheral surface 104 by the pressing roller 42, an effect of releasing the deformation of the sheet P to the outside is obtained (see FIG. 9). Accordingly, the sheet P can be made to come into close contact with (be held on) the peripheral surface 104 of the image recording drum 100 up to the rear end of the sheet P without the generation of wrinkles and floating.

[Example]

It is preferable that the specific sizes and the specific layout of the projections 106 disposed on the peripheral surface 104 of the image recording drum 100 are appropriately set in consideration of the thickness, the type, the size, and the like of a sheet P. That is, it is preferable that the sizes and the layout of the projections 106 are set so that a function to generate forces for pulling a sheet P to the outside is obtained in addition to a function to absorb the deformation of a sheet P.

The sizes and the layout of the projections 106 can be set as described below by way of example.

When the height of each of the projections 106 disposed in the middle region XC is denoted by h1 and the height of each of the projections 106 disposed in both the end regions XE is denoted by h2, the height of the projection 106 is set to a range in which conditions of "20 μm≤h1≤100 μm", "40 μm≤h2≤200 μm", and "h2≥2*h1" are satisfied (sign "*" means multiplication).

The diameter d of the projection 106 is set to the range of 0.5 mm to 3 mm (0.5 mm≤d≤3 mm).

Further, when the diameter of each of the projections 106 disposed in the middle region XC is denoted by d, the interval c between the projections 106 is set to the range of "6*d≥c≥d" (sign "*" means multiplication).

When the width of the largest sheet P, which can be printed by the apparatus, (the width of the largest sheet P in the X direction) is denoted by WP, the width WC of the middle region XC in the X direction is set to the range of WP/4 to WP/2 (WP/4≤WC≤WP/2). That is, the middle region XC is set to the range of WP/4 to WP/2 at the middle portion of the image recording drum 100 in the width direction (the X direction), and regions positioned on both sides of the middle region XC are set as both the end regions XE.

[Modification examples of third embodiment]

Figure 25:
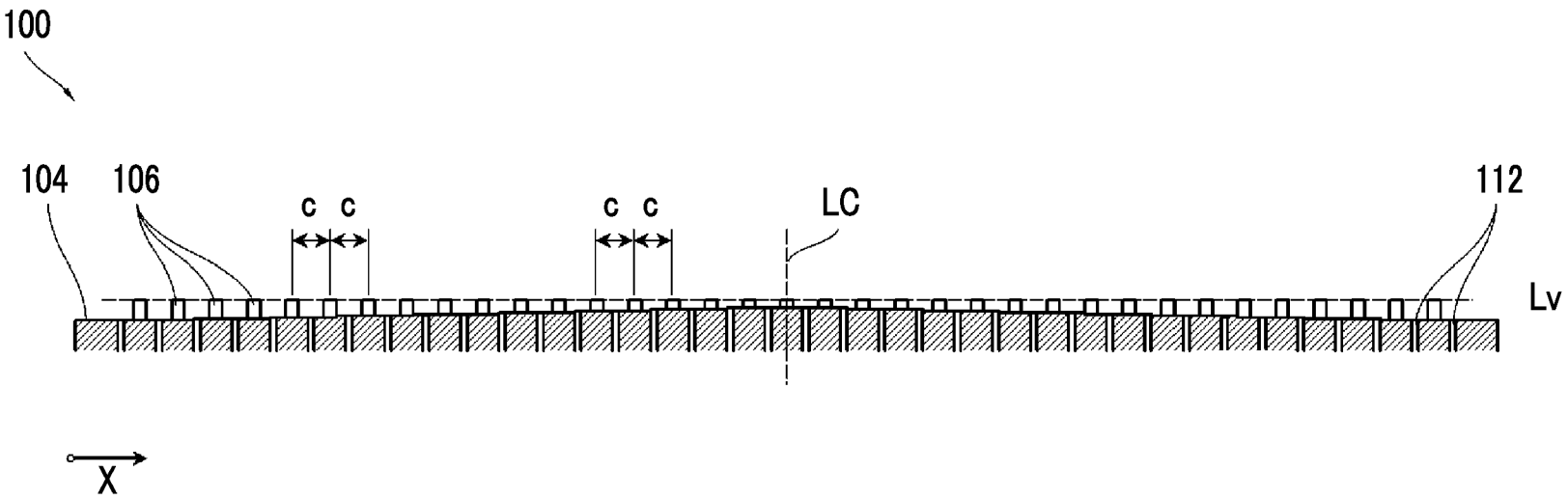
FIG. 25 is a view showing Modification example (1) of a third embodiment.

FIG. 25 is a view showing Modification example (1) of the third embodiment, and is a cross-sectional view of the peripheral surface 104 of the image recording drum 100. In FIG. 25, a broken line LC is the centerline of the peripheral surface 104 of the image recording drum 100 in the width direction (the X direction).

In an example shown in FIG. 25, in regard to the width direction (the X direction), the height of a projection 106 is set to be gradually increased toward both ends from the middle in the width direction (the X direction). Even in this case, the respective projections 106 are disposed so that the height positions of ends of the projections 106 are aligned with each other.

Figure 26:
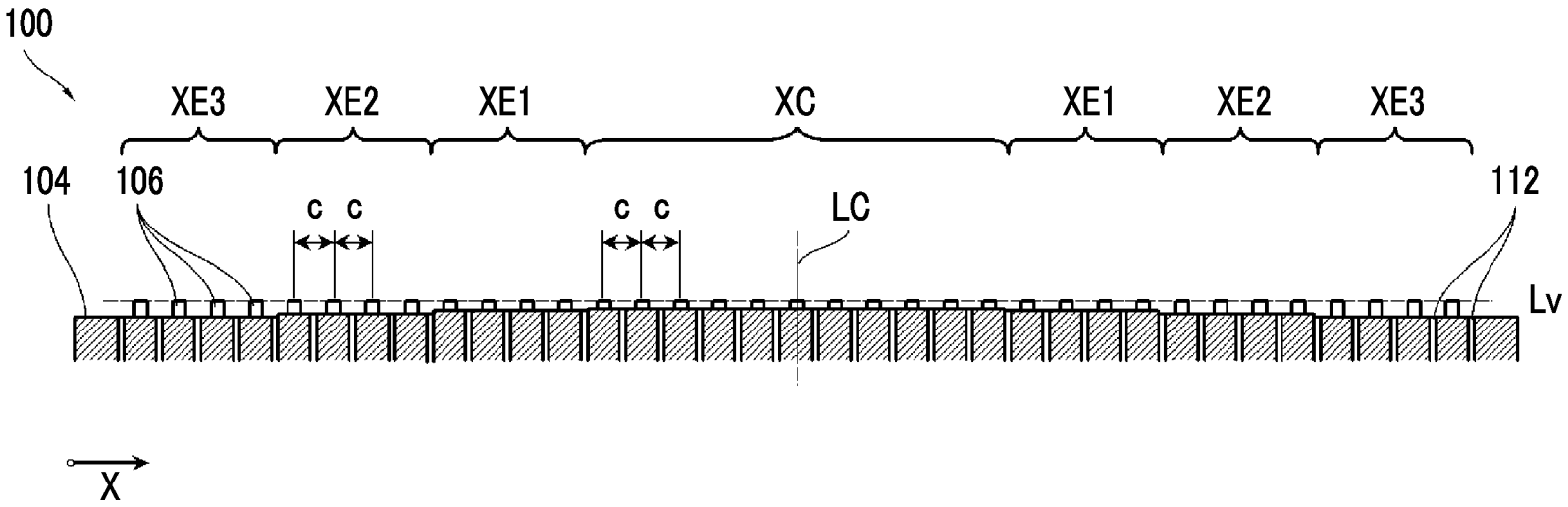
FIG. 26 is a view showing Modification example (2) of the third embodiment.

FIG. 26 is a view showing Modification example (2) of the third embodiment, and is a cross-sectional view of a part of the peripheral surface 104 of the image recording drum 100. In FIG. 26, a broken line LC is the centerline of the peripheral surface 104 of the image recording drum 100 in the width direction (the X direction).

In an example shown in FIG. 26, in regard to the width direction (the X direction), the height of a projection 106 is set to be increased in stages toward both ends from the middle in the width direction (the X direction). Even in this case, the respective projections 106 are disposed so that the height positions of ends of the projections 106 are aligned with each other.

In an example shown in FIG. 26, the peripheral surface 104 of the image recording drum 100 is divided into four kinds of regions, that is, a middle region XC, first outer regions XE1 that are positioned outside the middle region XC, second outer regions XE2 that are positioned outside the first outer regions XE1, and third outer regions XE3 that are positioned outside the second outer regions XE2; and the height of the projection 106 is set to be increased in stages toward the outer regions. That is, the projections disposed in each region have the same height; but the height of each of the projections 106 disposed in the first outer regions XE1 is set to be larger than the height of each of the projections 106 disposed in the middle region XC. Further, the height of each of the projections 106 disposed in the second outer regions XE2 is set to be larger than the height of each of the projections 106 disposed in the first outer regions XE1. Furthermore, the height of each of the projections 106 disposed in the third outer regions XE3 is set to be larger than the height of each of the projections 106 disposed in the second outer regions XE2.

Fourth Embodiment

In the first embodiment, an uneven shape, which realizes a desired function, is formed on the peripheral surface 104 of the image recording drum 100 by a change in the interval between the projections 106 that form the protruding portions. Further, in the second embodiment, an uneven shape, which realizes a desired function, is formed on the peripheral surface 104 of the image recording drum 100 by a change in the diameter (the area of the surface coming into contact with the sheet P) of each of the projections 106 that form the protruding portions. Furthermore, in the third embodiment, an uneven shape, which realizes a desired function, is formed on the peripheral surface 104 of the image recording drum 100 by a change in the height of each of the projections 106 that form the protruding portions.

In this way, the recessed portions and the protruding portions, which are formed on the peripheral surface 104 of the image recording drum 100, can realize a desired function by a change in the interval between the projections 106, which form the protruding portions, and a change in the diameter and height of each of the projections 106. Accordingly, a desired function can be realized by a combination of a plurality of changes among the changes in the interval, the diameter, and the height. For example, recessed portions and protruding portions, which realize a desired function, can also be formed on the peripheral surface 104 of the image recording drum 100 by a change in the diameter and height of each of the projections 106 that are disposed in the middle region XC and both the end regions XE. In this case, for example, the height of each of the projections 106 disposed in the middle region XC is set to be smaller than the height of each of the projections 106 disposed in both the end regions XE and the diameter of each of the projections 106 disposed in the middle region XC is set to be larger than the diameter of each of the projections 106 disposed in both the end regions XE. Further, for example, in a case in which the interval and the diameter are combined with each other, the interval between the projections 106 disposed in the middle region XC is set to be smaller than the interval between the projections 106 disposed in both the end regions XE and the diameter of each of the projections 106 disposed in the middle region XC is set to be larger than the diameter of each of the projections 106 disposed in both the end regions XE.

In this way, the recessed portions and the protruding portions, which are formed on the peripheral surface 104 of the image recording drum 100, can realize a desired function by a change in at least one of the interval between the projections 106, which form the protruding portions, and the diameter and height of each of the projections 106.

Fifth Embodiment

In a series of the embodiments, the projections 106 are disposed on the peripheral surface 104 of the image recording drum 100 to form a desired uneven shape on the peripheral surface 104 of the image recording drum 100. However, it is also possible to form a desired uneven shape on the peripheral surface 104 of the image recording drum 100 by forming the recessed portions on the peripheral surface 104 of the image recording drum 100.

In this case, for example, the recessed portions are formed so that the width (the X direction) of each of the recessed portions disposed in the middle region XC is narrower than the width of each of the recessed portions disposed in both the end regions XE in the cross-section taken in the width direction (the X direction). As a result, recessed portions and protruding portions are formed on the peripheral surface 104.

Further, for example, the recessed portions are formed so that the depth of each of the recessed portions disposed in the middle region XC is smaller than the depth of each of the recessed portions disposed in both the end regions XE in the cross-section taken in the width direction (the X direction). As a result, recessed portions and protruding portions are formed on the peripheral surface 104.

Figure 27:
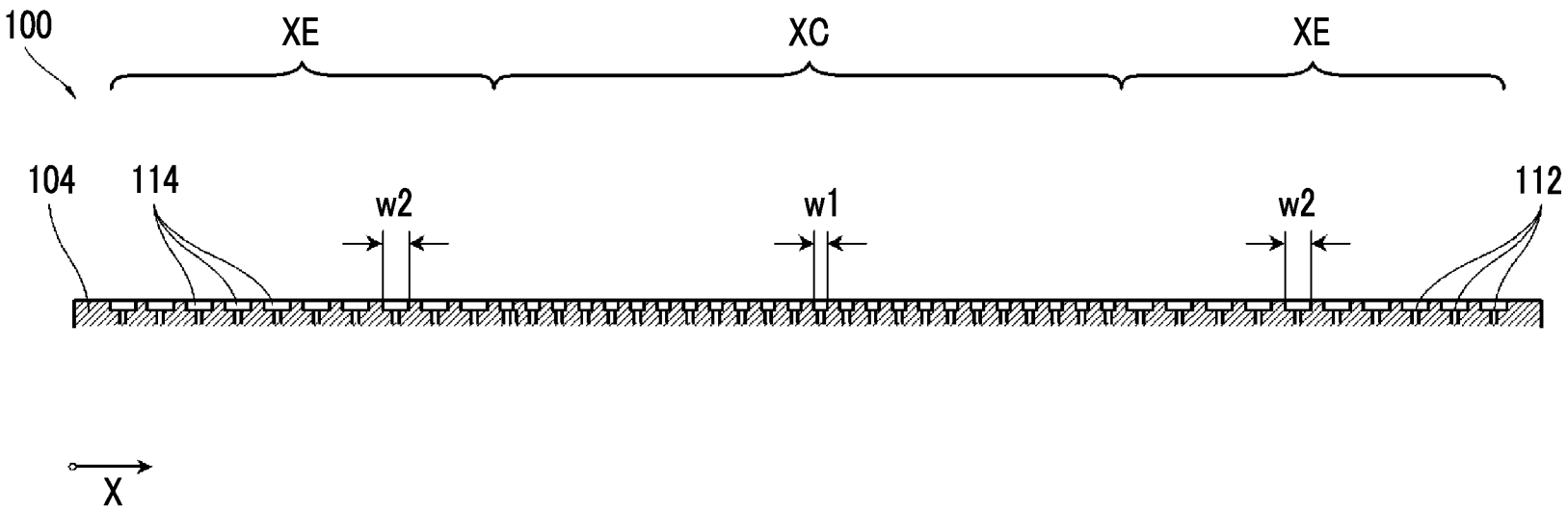
FIG. 27 is a cross-sectional view showing another example of the image recording drum.

FIG. 27 is a cross-sectional view showing an example of the image recording drum on which recessed portions and protruding portions are formed by recessed portions.

In an example shown in FIG. 27, recessed portions 114 are disposed on the peripheral surface 104 of the image recording drum 100 to form recessed portions and protruding portions formed on the peripheral surface 104 of the image recording drum 100. Particularly, in the example shown in FIG. 27, the recessed portions having the same depth are disposed on the peripheral surface 104 to form recessed portions and protruding portions. Accordingly, recessed portions and protruding portions, which realize a desired function, are formed by a change in the width of each of the recessed portions in a direction (the X direction) orthogonal to the conveying direction. That is, the width w1 of each of the recessed portions 114 disposed in the middle region XC is set to be smaller than the width w2 of each of the recessed portions 114 disposed in both the end regions XE, so that the volume of each of the recessed portions 114 formed in the both the end regions XE is larger than the volume of each of the recessed portions 114 formed in the middle region XC.

Since it is possible to form recessed portions and protruding portions, which are formed on the peripheral surface 104 of the image recording drum 100, by forming recessed portions on the peripheral surface 104 of the image recording drum 100 in this way, the same effect is obtained.

Considering that a sheet P is pressed by the pressing roller 42 so as to be made to be even, it is preferable that the recessed portions and the protruding portions, which are formed on the peripheral surface 104 of the image recording drum 100, are formed by projections 106 protruding from the peripheral surface 104.

Further, it is preferable that the outer peripheral edge of an end of each projection 106 is chamfered, particularly, is subjected to round chamfering (see FIG. 6). Accordingly, a sheet is more easily made to be even and damage to a sheet can also be prevented.

Sixth Embodiment

In a series of the embodiments, the columnar projections 106 are regularly disposed on the peripheral surface 104 of the image recording drum 100 to form a desired uneven shape on the peripheral surface 104 of the image recording drum 100. However, it is also possible to form a desired uneven shape on the peripheral surface 104 of the image recording drum 100 by forming stripe-shaped protruding portions (protrusions) or stripe-shaped recessed portions (grooves) along the circumferential direction on the peripheral surface 104 of the image recording drum 100.

That is, it is also possible to form desired recessed portions and desired protruding portions by disposing the protrusions or the grooves, which are formed along the circumferential direction, at a predetermined interval in the width direction (the X direction). In this case, an interval between the protrusions or the grooves disposed in a middle region is set to be smaller than an interval between the protrusions or the grooves disposed in both end regions.

Further, it is also possible to form desired recessed portions and desired protruding portions by disposing protrusions or grooves, which are formed along the circumferential direction, at regular intervals in the width direction and adjusting the width of each of the protrusions or the grooves. In this case, the width of each of the protrusions or the grooves disposed in the middle region is set to be wider than the width of each of the protrusions or the grooves disposed in both the end regions.

In addition, it is also possible to form desired recessed portions and desired protruding portions by disposing protrusions or grooves, which are formed along the circumferential direction, at regular intervals in the width direction and adjusting the height of each of the protrusions or the depth of each of the grooves. In this case, the height of each of the protrusions disposed in the middle region is set to be smaller than the height of each of the protrusions disposed in both the end regions. Alternatively, the depth of each of the grooves disposed in the middle region is set to be smaller than the depth of each of the grooves disposed in both the end regions.

Figure 28:
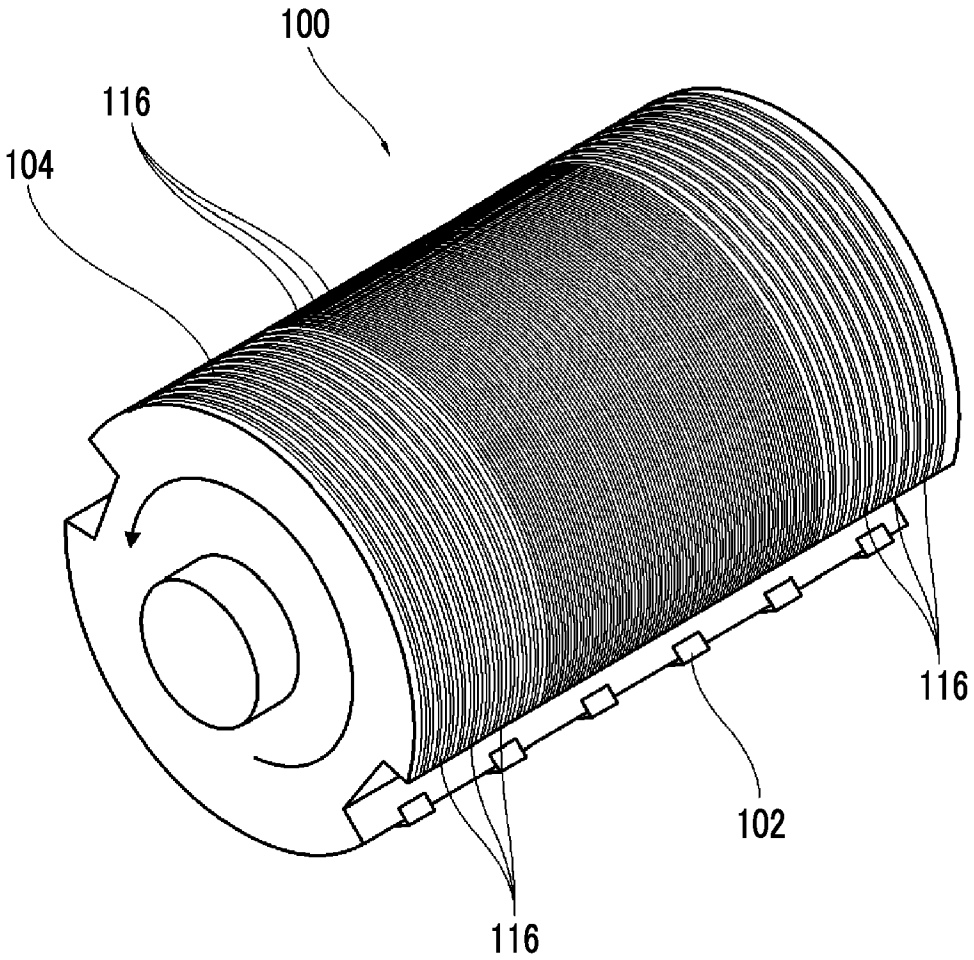
FIG. 28 is a perspective view showing another example of the image recording drum.

FIG. 28 is a perspective view showing an example of the image recording drum of which the peripheral surface is provided with recessed portions and protruding portions that are formed by protrusions.

As shown in FIG. 28, protrusions 116 having the same width and the same height are disposed on the peripheral surface 104 of the image recording drum 100 to form recessed portions and protruding portions on the peripheral surface 104 of the image recording drum 100. Further, an interval between the protrusions 116 disposed in the middle region is set to be different from an interval between the protrusions 116 disposed in both the end regions, so that an uneven shape realizing a desired function is formed. That is, the interval between the protrusions 116 disposed in the middle region is set to be smaller than the interval between the protrusions 116 disposed in both the end regions XE. Accordingly, the recessed portions and the protruding portions are formed in a shape in which the cross-sectional area of a recessed portion formed between adjacent protruding portions disposed at both end portions is larger than that at the middle portion in the width direction in the cross-section taken in the width direction (the X direction). Further, the recessed portions and the protruding portions are formed in a shape in which the volume of the recessed portion formed between adjacent protruding portions disposed at both the end portions is larger than that at the middle portion in the width direction.

The recessed portions and the protruding portions, which are formed on the peripheral surface 104 of the image recording drum 100, can also be formed by the protrusions or the grooves in this way. The same effect as the effect of the columnar projections can be obtained even in this case.

Other Embodiments

Arrangement of Projections

Figure 29:
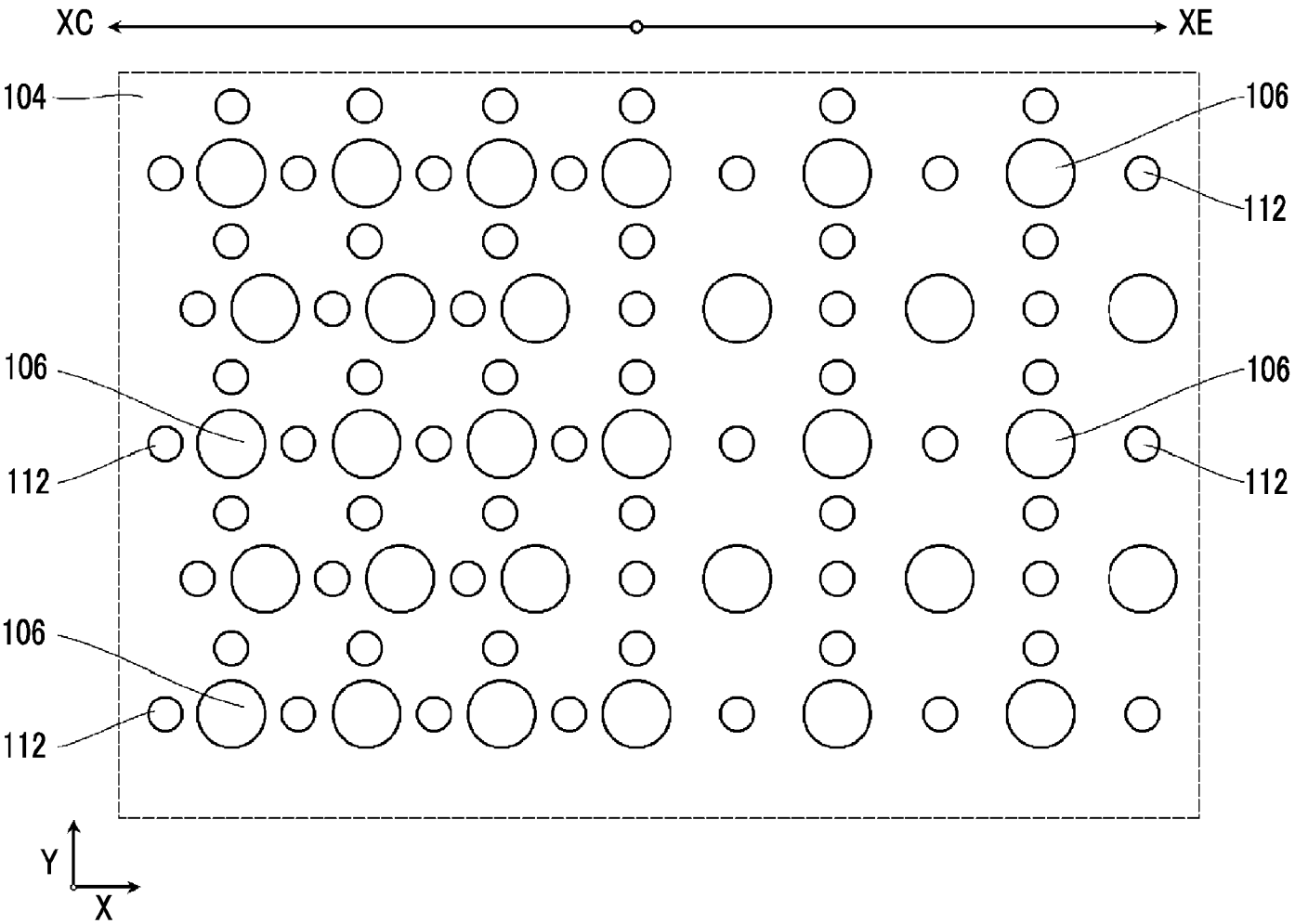
FIG. 29 is a view showing another example of the arrangement of projections.

FIG. 29 is a view showing another example of the arrangement of projections.

The projections 106 have been disposed at regular intervals in the conveying direction of a sheet P (the Y direction) in the above-mentioned embodiments, but may also be disposed in a zigzag pattern as shown in FIG. 29.

Further, the projection 106 is not limited to a columnar shape, and may have a hemisphere shape (dome shape), the shape of a quadrangular prism, or the shape of a polygonal prism.

Another Example of a Conveying Unit

Figure 30:
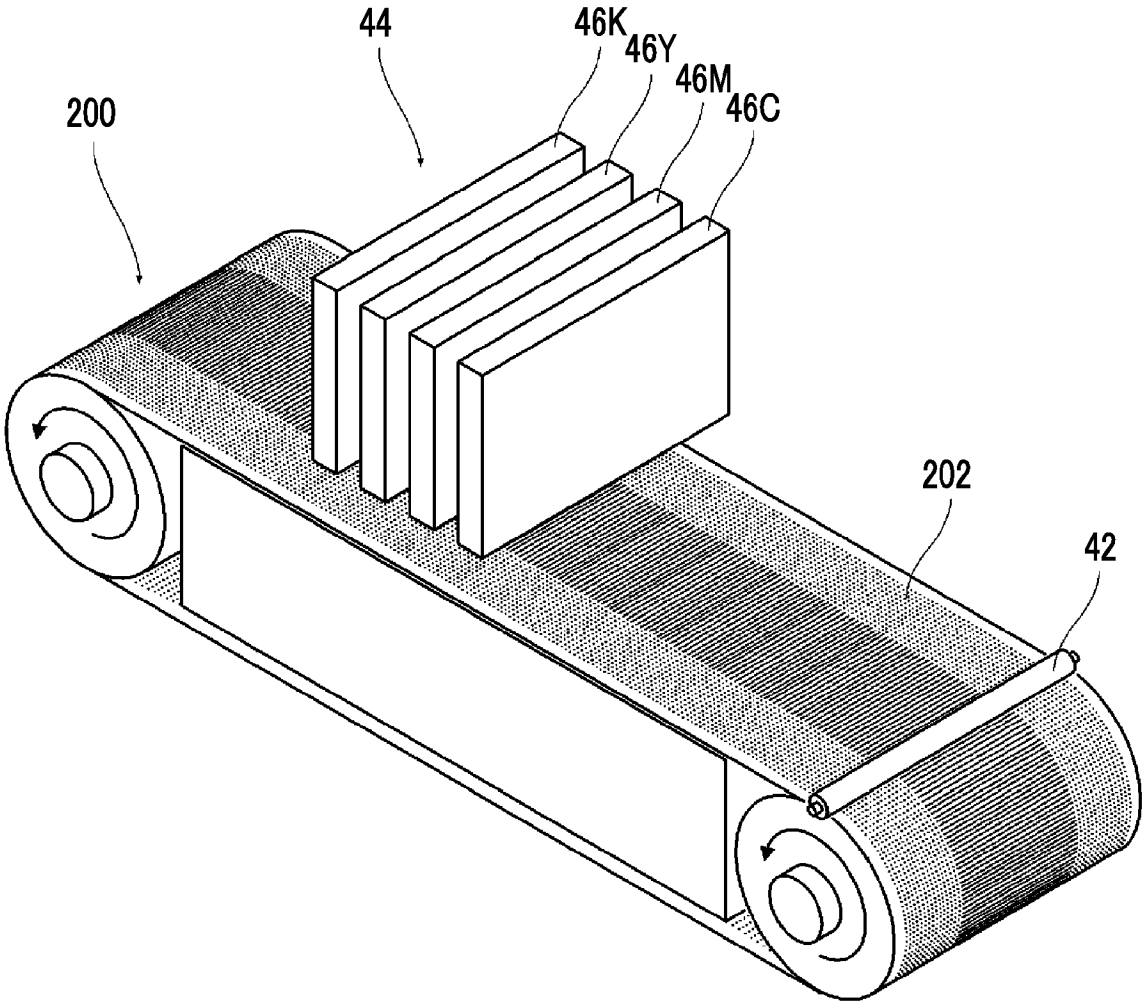
FIG. 30 is a perspective view showing another example of a conveying unit.

FIG. 30 is a perspective view showing another example of a conveying unit.

The conveying unit has been formed of a rotating drum (image recording drum 100) in the above-mentioned embodiments, but the conveying unit may also be formed of an endless belt 200 that travels along a fixed path as shown in FIG. 30. In this case, the peripheral surface 202 of the belt 200 forms a medium holding surface. Accordingly, recessed portions and protruding portions are formed on the peripheral surface 202 of the belt 200.

Another Example of a Pressing Unit

The pressing roller 42 has been used as means for pressing a sheet P, which is a medium, against the peripheral surface 104 of the image recording drum 100 and making the sheet P come into close contact with the peripheral surface 104 in the above-mentioned embodiments, but the means for making the sheet P come into close contact with the peripheral surface 104 of the image recording drum 100 is not limited thereto. For example, a sheet P may also be pressed against the peripheral surface 104 of the image recording drum 100 by a pressing member having an arc surface.

Suction Mechanism

In the above-mentioned embodiments, a sheet P has been held on the peripheral surface 104 of the image recording drum 100 by suction using air pressure (negative pressure). However, a mechanism, which holds a sheet P on the peripheral surface 104 of the image recording drum 100 by suction, is not limited thereto. Besides, a sheet P may also be attracted (electrostatically attracted) to the peripheral surface 104 of the image recording drum 100 by, for example, static electricity.

Image Recording Apparatus

Cases in which the invention is applied to an ink jet printing machine have been described in the above-mentioned embodiments by way of example, but the application of the invention is not limited thereto. The invention can be applied to general apparatuses for conveying a sheet-like medium.

Further, cases in which the invention is applied to the image recording drum 100 of the image recording section 40 have been described in the above-mentioned embodiments by way of example, but the invention can be applied to other drums likewise.

EXPLANATION OF REFERENCES

1: image recording apparatus
10: sheet feeding section
12: sheet feeding device
14: feeder board
16: sheet feed drum
17: gripper
20: treatment liquid applying section
22: treatment liquid applying drum
23: gripper
24: treatment liquid applying device
30: treatment liquid drying section
32: treatment liquid drying drum
33: gripper
34: treatment liquid drying device
40: image recording section
42: pressing roller
44: head unit
46C, 46M, 46Y, 46K: ink jet head
48: scanner
50: ink drying section
52: chain gripper
52A: chain
52B: gripper
54: sheet guide
54A: first guide board
54B: second guide board
56: heating-drying device
56A: infrared lamp
60: collection section
62: collection device
100: image recording drum
102: gripper
104: peripheral surface (medium holding surface)
106: projection (protruding portion)
108: motor
110: vacuum pump
112: suction hole
114: recessed portion
116: protrusion
200: belt
202: peripheral surface (medium holding surface)

What is claimed is:

1. A medium conveying device comprising:

a conveying unit for conveying a sheet-like medium while making the sheet-like medium come into close contact with a moving medium holding surface; and a pressing unit for making the medium come into close contact with the medium holding surface by pressing the medium against the medium holding surface, wherein the medium holding surface has recessed portions and protruding portions, and the recessed portions and the protruding portions have a shape in which the volume of recessed portions per unit area of the medium holding surface is gradually increased toward both ends from a middle in a width direction that is a direction orthogonal to a conveying direction of the medium.

2. A medium conveying device comprising:

a conveying unit for conveying a sheet-like medium while making the sheet-like medium come into close contact with a moving medium holding surface; and a pressing unit for making the medium come into close contact with the medium holding surface by pressing the medium against the medium holding surface, wherein the medium holding surface has recessed portions and protruding portions, and the recessed portions and the protruding portions have a shape in which the volume of the recessed portions per unit area of the medium holding surface is increased in stages toward both ends from a middle in a width direction that is a direction orthogonal to a conveying direction of the medium.

3. The medium conveying device according to claim 1, wherein protruding portions having the same size are regularly disposed on the medium holding surface, so that the recessed portions and the protruding portions are formed on the medium holding surface, and the recessed portions and the protruding portions are formed in a shape in which an interval between adjacent protruding portions disposed at the middle portion in the width direction is different from an interval between adjacent protruding portions disposed at both the end portions in the width direction, so that the volume of the recessed portions per unit area of the medium holding surface at both the end portions in the width direction is larger than the volume of the recessed portions per unit area of the medium holding surface at the middle portion in the width direction.

4. The medium conveying device according to claim 2, wherein protruding portions having the same size are regularly disposed on the medium holding surface, so that the recessed portions and the protruding portions are formed on the medium holding surface, and the recessed portions and the protruding portions are formed in a shape in which an interval between adjacent protruding portions disposed at the middle portion in the width direction is different from an interval between adjacent protruding portions disposed at both the end portions in the width direction, so that the volume of the recessed portions per unit area of the medium holding surface at both the end portions in the width direction is larger than the volume of the recessed portions per unit area of the medium holding surface at the middle portion in the width direction.

5. A medium conveying device comprising:

a conveying unit for conveying a sheet-like medium while making the sheet-like medium come into close contact with a moving medium holding surface; and a pressing unit for making the medium come into close contact with the medium holding surface by pressing the medium against the medium holding surface, wherein the medium holding surface has recessed portions and protruding portions, the protruding portions are regularly disposed on the medium holding surface at regular intervals, so that the recessed portions and the protruding portions are formed on the medium holding surface, and the recessed portions and the protruding portions are formed in a shape in which the area of the surface, which comes into contact with the medium, of each of the protruding portions disposed at the middle portion in a width direction that is a direction orthogonal to a conveying direction of the medium is different from the area of the surface, which comes into contact with the medium, of each of the protruding portions disposed at both the end portions in the width direction, so that the volume of the recessed portions per unit area of the medium holding surface at both the end portions in the width direction is larger than the volume of the recessed portions per unit area of the medium holding surface at the middle portion in the width direction.

6. The medium conveying device according to claim 1, wherein protruding portions are regularly disposed on the medium holding surface at regular intervals, so that the recessed portions and the protruding portions are formed on the medium holding surface, and the recessed portions and the protruding portions are formed in a shape in which the height of each of the protruding portions disposed at the middle portion in the width direction is different from the height of each of the protruding portions disposed at both the end portions in the width direction, so that the volume of the recessed portions per unit area of the medium holding surface at both the end portions in the width direction is larger than the volume of the recessed portions per unit area of the medium holding surface at the middle portion in the width direction.

7. The medium conveying device according to claim 2, wherein protruding portions are regularly disposed on the medium holding surface at regular intervals, so that the recessed portions and the protruding portions are formed on the medium holding surface, and the recessed portions and the protruding portions are formed in a shape in which the height of each of the protruding portions disposed at the middle portion in the width direction is different from the height of each of the protruding portions disposed at both the end portions in the width direction, so that the volume of the recessed portions per unit area of the medium holding surface at both the end portions in the width direction is larger than the volume of the recessed portions per unit area of the medium holding surface at the middle portion in the width direction.

8. The medium conveying device according to claim 1, wherein protruding portions are regularly disposed on the medium holding surface, so that the recessed portions and the protruding portions are formed on the medium holding surface, and the recessed portions and the protruding portions are formed in a shape in which at least one of the interval between adjacent protruding portions disposed at the middle portion in the width direction, the area of the surface, which comes into contact with the medium, of each of the protruding portions disposed at the middle portion in the width direction, or the height of each of the protruding portions disposed at the middle portion in the width direction is different from the interval between adjacent protruding portions disposed at both the end portions in the width direction, the area of the surface, which comes into contact with the medium, of each of the protruding portions disposed at both the end portions in the width direction, or the height of each of the protruding portions disposed at both the end portions in the width direction, respectively, so that the volume of the recessed portions per unit area of the medium holding surface at both the end portions in the width direction is larger than the volume of the recessed portions per unit area of the medium holding surface at the middle portion in the width direction.

9. The medium conveying device according to claim 2, wherein protruding portions are regularly disposed on the medium holding surface, so that the recessed portions and the protruding portions are formed on the medium holding surface, and the recessed portions and the protruding portions are formed in a shape in which at least one of the interval between adjacent protruding portions disposed at the middle portion in the width direction, the area of the surface, which comes into contact with the medium, of each of the protruding portions disposed at the middle portion in the width direction, or the height of each of the protruding portions disposed at the middle portion in the width direction is different from the interval between adjacent protruding portions disposed at both the end portions in the width direction, the area of the surface, which comes into contact with the medium, of each of the protruding portions disposed at both the end portions in the width direction, or the height of each of the protruding portions disposed at both the end portions in the width direction, respectively, so that the volume of the recessed portions per unit area of the medium holding surface at both the end portions in the width direction is larger than the volume of the recessed portions per unit area of the medium holding surface at the middle portion in the width direction.

10. The medium conveying device according to claim 1, wherein projections, which protrude from the medium holding surface, are regularly disposed as the protruding portions, so that the recessed portions and the protruding portions are formed.

11. The medium conveying device according to claim 2, wherein projections, which protrude from the medium holding surface, are regularly disposed as the protruding portions, so that the recessed portions and the protruding portions are formed.

12. The medium conveying device according to claim 3, wherein projections, which protrude from the medium holding surface, are regularly disposed as the protruding portions, so that the recessed portions and the protruding portions are formed.

13. The medium conveying device according to claim 4, wherein projections, which protrude from the medium holding surface, are regularly disposed as the protruding portions, so that the recessed portions and the protruding portions are formed.

14. The medium conveying device according to claim 5, wherein projections, which protrude from the medium holding surface, are regularly disposed as the protruding portions, so that the recessed portions and the protruding portions are formed.

15. The medium conveying device according to claim 10, wherein the projection has a columnar shape.

16. The medium conveying device according to claim 15, wherein the projection has the shape of a column of which an outer peripheral edge of an end is chamfered.

17. The medium conveying device according to claim 1, wherein the conveying unit is a rotating drum, and the peripheral surface of the drum is the medium holding surface.

18. The medium conveying device according to claim 1, wherein the conveying unit is an endless belt that travels along a fixed path, and the peripheral surface of the belt forms the medium holding surface.

19. An image recording apparatus comprising:

the medium conveying device according to claim 1; and an image recording unit for recording an image on the medium conveyed by the medium conveying device.

20. The image recording apparatus according to claim 19, wherein the image recording unit records an image by an ink jet method.

* * * * *